US008864222B2

(12) United States Patent
Grace

(10) Patent No.: US 8,864,222 B2
(45) Date of Patent: Oct. 21, 2014

(54) UNIFOLDABLE RECLINING CHAIR

(76) Inventor: Daniel R. Grace, Old Saybrook, CT (US)

( * ) Notice: Subject to any disclaimer, the term of this patent is extended or adjusted under 35 U.S.C. 154(b) by 705 days.

(21) Appl. No.: 12/840,915

(22) Filed: Jul. 21, 2010

(65) Prior Publication Data

US 2011/0018312 A1 Jan. 27, 2011

Related U.S. Application Data

(60) Provisional application No. 61/227,191, filed on Jul. 21, 2009.

(51) Int. Cl.

| | |
|---|---|
| ***A47C 4/38*** | (2006.01) |
| ***A47C 4/48*** | (2006.01) |
| ***A47C 7/54*** | (2006.01) |
| ***A47C 1/026*** | (2006.01) |
| ***A47C 4/28*** | (2006.01) |

(52) U.S. Cl.

CPC ..... *A47C 7/54* (2013.01); *A47C 1/0265* (2013.01); *A47C 4/286* (2013.01)

USPC ..... 297/44; 297/35; 297/354.12

(58) Field of Classification Search

USPC ..... 297/44, 45, 42, 35, 354.12, 361.1

See application file for complete search history.

(56) References Cited

U.S. PATENT DOCUMENTS

| | | | | |
|---|---|---|---|---|
| 703,077 | A | 6/1902 | Nivison | |
| 1,214,701 | A * | 2/1917 | Mernyk | 297/111 |
| 2,638,970 | A * | 5/1953 | Harber | 297/39 |
| 3,730,584 | A | 5/1973 | Uchida | |
| 4,715,650 | A | 12/1987 | Berman et al. | |
| 4,826,241 | A | 5/1989 | Barras | |
| 4,898,421 | A * | 2/1990 | Brunn | 297/28 |
| 5,570,928 | A | 11/1996 | Staunton et al. | |
| 5,855,409 | A * | 1/1999 | Tseng | 297/35 |
| 5,931,526 | A * | 8/1999 | Tseng | 297/27 |
| 6,062,648 | A * | 5/2000 | Adler | 297/440.24 |
| 6,082,813 | A | 7/2000 | Chen | |
| 6,302,479 | B1 | 10/2001 | Zheng | |
| 6,364,409 | B1 | 4/2002 | Saul et al. | |
| 6,406,091 | B1 | 6/2002 | Saul et al. | |
| 6,736,450 | B2 | 5/2004 | Miyagi | |
| 6,764,132 | B1 | 7/2004 | Gaertner | |
| 6,840,574 | B1 * | 1/2005 | Wu | 297/45 |
| 6,871,905 | B2 | 3/2005 | Grace | |
| 6,926,356 | B2 | 8/2005 | Chen | |
| 7,017,984 | B2 | 3/2006 | Chen | |
| 7,073,852 | B1 | 7/2006 | Zheng | |
| 7,178,863 | B1 | 2/2007 | Norval | |

(Continued)

*Primary Examiner* — David R Dunn
*Assistant Examiner* — Timothy J Brindley

(57) ABSTRACT

A unifoldable reclining chair design has a collapsible articulated frame and includes a pair of opposing side assemblies having longitudinally elongated pivotally connected side frame members that are maintained in opposing transversally spaced relation by front and rear collapsible X-shaped connector assemblies. Slidable pivot connections, or alternatively, pivotal connecting linkages, which join the rear connector assembly to associated side frame members, enable all of the frame members to move substantially in unison and in multiple directions relative to each other while simultaneously undergoing multiple changes in an angular position relative to each other to move the chair frame from a set-up condition for use to a collapsed condition for transportation and/or storage in response to a single folding action. The slidable pivot connections and pivotal connecting linkages also enable a chair occupant to change the angular position of the chair back support when seated or reclined in the set-up chair.

19 Claims, 16 Drawing Sheets

(56) References Cited

U.S. PATENT DOCUMENTS

| | | | | |
|---|---|---|---|---|
| 7,240,961 | B2 | 7/2007 | Grace | |
| 7,717,503 | B1 | 5/2010 | Watson | |
| 8,251,442 | B2 * | 8/2012 | Grace | 297/45 |
| 2003/0025360 | A1 | 2/2003 | Liu | |
| 2003/0025361 | A1 | 2/2003 | Liu | |
| 2003/0034675 | A1 | 2/2003 | Marx | |
| 2003/0071493 | A1 | 4/2003 | Miyagi | |
| 2004/0207237 | A1 | 10/2004 | Chen | |
| 2004/0212224 | A1 | 10/2004 | Chen | |
| 2008/0122268 | A1 | 5/2008 | Kim | |
| 2010/0072790 | A1 * | 3/2010 | Pleiman et al. | 297/45 |
| 2010/0171342 | A1 | 7/2010 | Chen | |
| 2011/0018312 | A1 | 1/2011 | Grace | |
| 2011/0169304 | A1 | 7/2011 | Chen | |

* cited by examiner

UNIFOLDABLE RECLINING CHAIR

CROSS REFERENCE TO RELATED APPLICATION

This application claims the benefit of U.S. Provisional Application No. 61/227,191, filed Jul. 21, 2009, the disclosure of which is incorporated herein by reference in its entirety.

FIELD OF THE INVENTION

The present invention generally relates to folding chairs, and more particularly relates to improvements in reclining chairs that are foldable and unfoldable between a set-up condition for use and a substantially collapsed and bundled condition for transportation and/or storage.

BACKGROUND OF THE INVENTION

Beach and lawn chairs adapted to be folded for transportation and/or storage typically have a frame fabricated from elongated structural members, preferably metal. The frames of such chairs have transversely spaced apart left hand and right hand frame side assemblies that are substantially parallel to each other. In a set-up condition, each side frame assembly has a front leg member extending in a generally vertically upward direction and a rear leg member pivotally connected at its upper end directly or indirectly to an upper end of the front leg member and which is rearwardly and downwardly inclined from the upper end of the front leg member. Such side frame assemblies also include an upwardly extending chair back support member which is pivotally connected at its lower end to the rear leg member intermediate the ends of the rear leg member by an over-the-center linkage that positions the back support member so that it is supported at its lower end on the rear leg member and inclined upwardly and rearwardly therefrom when the chair is unfolded from its closed or flatly folded storage condition to its open or set-up condition for use. Such side frame assemblies also include a seat support member generally supported by the front and rear leg members in a generally horizontal condition when the chair is in its set-up condition.

Conventional beach and lawn chairs of the prior art having the left hand and right hand frame side assemblies such as hereinbefore generally described also commonly have transversely extending rigid connecting members providing fixed connection between the front leg members, the rear leg members, and often the back support members as well. Additional rigidly fixed transverse connecting members may also extend between the structural members that support the seat of such a chair. The aforesaid rigid or non-collapsible transversely extending connecting members are generally horizontally disposed when such a conventional prior art chair is in its set-up condition. Thus, it should be immediately apparent that conventional folding chairs of a prior art type as hereinbefore described are foldable to only one storage and/or transport condition, namely a flatly folded condition.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. However, even though such chairs are foldable for easy transport, they typically still cover a wide area and thus take up a lot of space when folded, which makes packing or storing the chairs difficult, especially when they must be crammed into a space such as the trunk of a car with a number of other objects such as a cooler, blankets and bags. That is, most prior art beach and lawn chairs are foldable only in one direction—typically front to back. For example, the back support and the seat support of the chair are folded towards each other so the frame, when folded, lies flat in an essentially rectangular shape. When packing the folded chair into a car, the folded chair must be laid flat, thereby occupying a wide footprint in the car.

Other chair designs have been developed that can be folded to a collapsed or bundled state occupying less storage space. For example, some chair designs can be folded in multiple directions, reducing at least the front/back and left/right dimensions between an unfolded set-up condition and a folded, storage condition. However, these chair designs are typically not suitable for certain outdoor uses, such as at the beach or at a picnic, where a reclinable backrest is desired. Heretofore, multi-directional foldable chairs have not been capable of reclining due to the complexity of the means of connecting the various frame members constituting the chair frame.

In view of the foregoing, there is a need for a chair with a reclining back support when in a set-up condition that can be collapsed in multiple directions in order to reduce the space occupied by the chair in a folded and completely collapsed condition. Further, there is a need for such a chair that can be folded to a completely collapsed, bundled condition with minimal effort, without limiting or compromising the structural features permitting reclining of the chair's backrest support. Accordingly, it is a general object of the present invention to provide a unifoldable reclining chair design that overcomes the problems and drawbacks associated with reclinable folding chairs, and therefore significantly improves the utility of such a chair in the set-up condition while permitting easy transportation and/or storage in a completely collapsed condition.

In general, there is a need for a reclinable and collapsible chair that can be easily folded by a user with minimal effort. In this regard, a desirable folding chair design reduces the number of folding steps. It is a general object of the present invention, therefore, to provide a chair that can be easily folded and collapsed in multiple directions, essentially front to back and left to right, with a single folding action—e.g., inward force on the armrests of the chair. In this regard, such a chair design that can be folded from its set-up condition to a completely collapsed and bundled condition with a single folding action is herein referred to as a unifoldable chair.

It is another object of the present invention to provide a unique foldable reclining chair frame structure that is lightweight, easily transportable, easily storable, and easy to operate between its set-up condition and its collapsed condition, and that further builds upon design concepts in the inventor's own copending application Ser. No. 12/726,141 for a "Two Way Foldable Chair" and copending application Ser. No. 12/726,154 for a "Two Way Foldable Chair", both of which are incorporated herein by reference.

The present invention addresses these issues, and provides a means to circumvent the associated drawbacks of such prior art foldable chair designs.

SUMMARY OF THE INVENTION

The present invention is directed to a unifoldable reclining chair design especially suitable for use as a beach chair, a lawn chair, and the like, where the chair, in a set-up condition, has a reclining back support adjustable to a number of positions, and where the chair can be folded from the set-up condition to a completely collapsed condition with a single folding action. More particularly, in the completely collapsed condition, the chair is folded and collapsed in multiple directions, so that the front/back and left/right dimensions of the chair are reduced between the set-up condition and the completely collapsed condition.

Unlike the prior art hereinbefore described, the chair design of the present invention does not include or rely on rigid or non-collapsible connecting members that are fixedly connected to and extend between opposite side frame members to prevent movement of the side members either toward or away from each other.

The chair design of the present invention also permits folding from the set-up condition to the completely collapsed condition with a single folding action regardless of the position of the back support. That is, one need not return the back support to an upright position in order to completely collapse the chair. The chair will consistently collapse to the same bundled condition regardless of the amount the back support is reclined.

In accordance with an aspect of the present invention, a unifoldable reclining chair includes left and right frame side assemblies collectively defining forward and rear leg members, a seat support, and a back support, directly or indirectly interconnected by a combination of pivotal, slidable and telescopically movable connections that enable maintenance of the chair frame in an open or set-up condition. The chair also includes forward and rear connector assemblies connecting the left and right frame side assemblies and facilitating folding of the chair frame to a completely collapsed condition. In a preferred design, the connector assemblies each comprise two pivotable connectors that generally assume the shape of an X when the chair is in the set-up condition and that are disposed in generally parallel relationship when the chair is folded and collapsed. The rear connector assembly is preferably moveably attached between the back support members and the rear leg members to enable and accommodate angular adjustment of the back support relative to the seat support. Preferably, the rear connector assembly is moveable between at least first and second positions, wherein such positions correspond to respective first and second reclined positions of the back support. The combination of pivotal, slidable and telescopically movable structural members further enable the chair frame to be folded or collapsed in multiple directions, including at least the transverse, side-to-side direction and the front-to-back direction, by moving the chair frame members toward each other and a centrally disposed vertical axis from the set-up condition.

In accordance with various embodiments of the present invention, the rear connector assembly can be pivotally, slidably and/or telescopically attached to the rear leg members and/or the back support members to enable the back support to be reclined without affecting the set-up condition of the chair frame.

In one aspect of the present invention, the rear connector assembly is pivotally attached at one end to the back support members and at the other end to the rear leg members by means of a slide disposed within a guide rail mounted on the rear leg members. The combination of pivoting movement at each of the terminal ends of the connectors and the sliding of the lower terminal ends of the connectors along the guide rails enables and accommodates reclining of the back support relative to the seat support. In accordance with the design of the present invention, the slide also moves along the guide rail during set-up and collapsing of the chair.

In another aspect of the present invention, the rear connector assembly is pivotally attached at one end to the back support members and at the other end to the rear leg members by means of a pivotal linkage that enables and accommodates reclining of the back support relative to the seat support. In accordance with the design of the present invention, the linkages also pivot relative to the rear leg members during set-up and collapsing of the chair.

In still another aspect of the present invention, the rear connector assembly is pivotally attached at one end to the back support members and at the other end to the rear leg members by means of a sliding sleeve or collar that permits reclining of the back support relative to the seat support. In accordance with the design of the present invention, the sleeves also move along the rear leg members during set-up and collapsing of the chair.

In accordance with another aspect of the present invention, each of the left and right frame side assemblies includes a rear leg member having a first end defining the rear leg portion of the member, a second end defining the seat support member, and a bend intermediate the first and second ends. The back support members are pivotally connected to the rear leg member proximate the intermediate bend.

These and other features of the present invention are described with reference to the drawings of preferred embodiments of a unifoldable reclining chair. The illustrated embodiments of features of the present invention are intended to illustrate, but not limit the invention.

DETAILED DESCRIPTION OF PREFERRED EMBODIMENTS OF THE INVENTION

Figure 1:
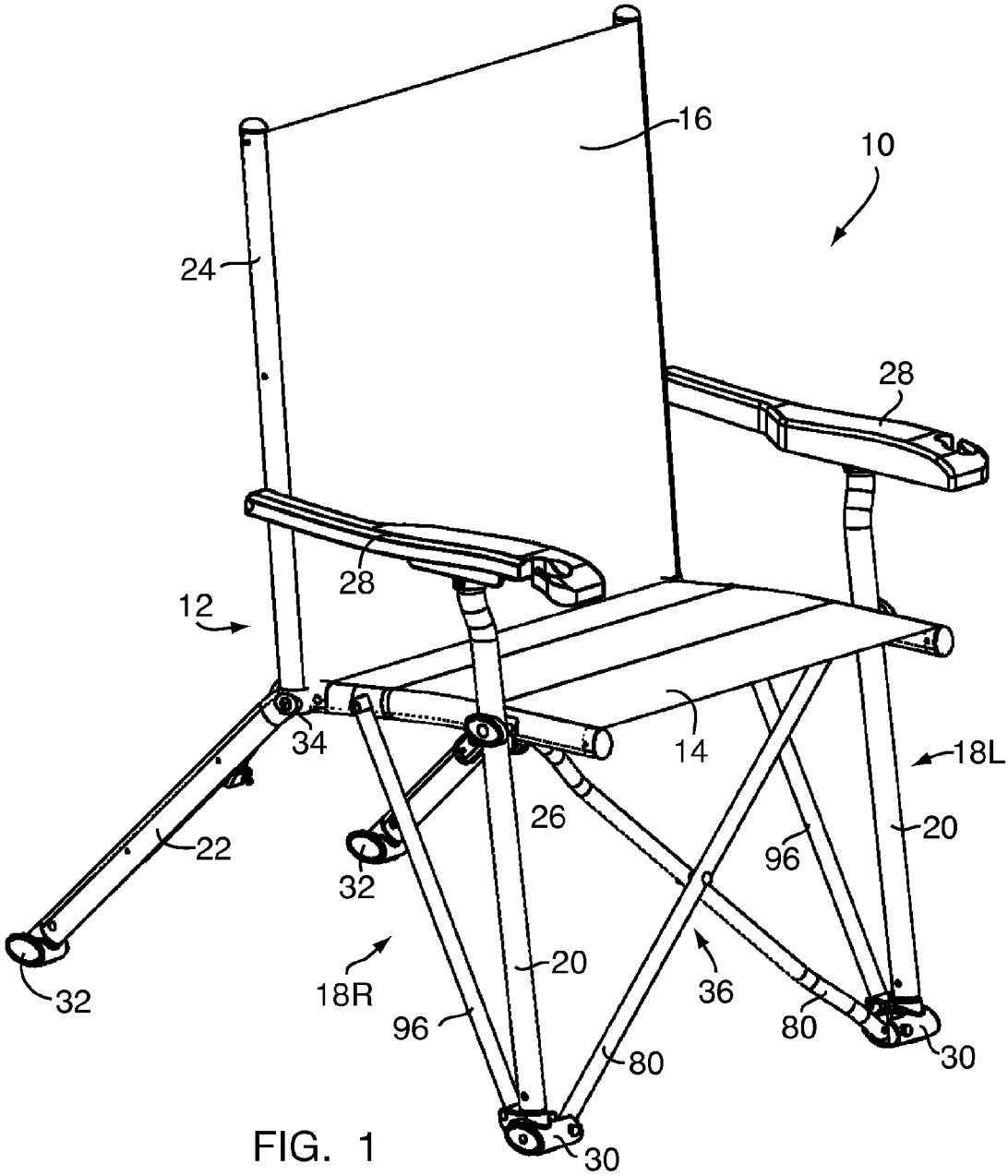
FIG. 1 is a perspective view of a unifoldable reclining chair in accordance with the present invention, with the chair in a set-up condition and the back support of the chair at its most forward and upright position.

In the drawings and in the description that follows the present invention is illustrated and described with reference to a unifoldable reclining chair design embodying the present invention. A chair, generally designated as reference numeral 10, is shown, for example, in FIG. 1 in a set-up condition ready for use. The chair 10 includes a frame 12 that carries a flexible generally rectangular seat support panel 14 and a flexible generally rectangular backrest support panel 16. The frame 12 is shown more particularly in FIG. 3 with the seat panel 14 and the backrest panel 16 removed. The frame 12 is comprised of several frame members pivotally, slidably and/or telescopically connected together to define the chair frame 12 and permit folding and collapsing of the frame 12 to a bundle suitable for easy transportation and storage. Preferably, the frame members are fabricated from a durable lightweight material such as a tubular metal or high-strength plastic. Various elongated structural parts or members that comprise the chair frame 12 are preferably constructed from cylindrical tubular material. Alternatively, tubing of non-circular cross-section, such as, for example, aluminum tubing having oval or elliptical cross-section, is employed for making the major elongated structural components of the chair frame 12, which in certain embodiments of the present invention restricts binding of the frame 12 when a person is sitting in the chair 10.

The seat panel 14 preferably provides a 17-inch seat height for the chair 10 when in a set-up condition for use. The backrest panel 16 preferably provides a high profile capable of supporting the user's upper back, neck and head, though various dimensions for the backrest panel 16 may be used without affecting operation of the chair 10 in accordance with the present invention. Further, the seat panel 14 and backrest panel 16 can be formed from a single piece of material with a transition section at the rear of the seat and the bottom of the backrest. The seat and backrest panels 14 and 16 may be made from fabric or other suitable flexible, durable and weather resistant sheet material.

Figure 5:
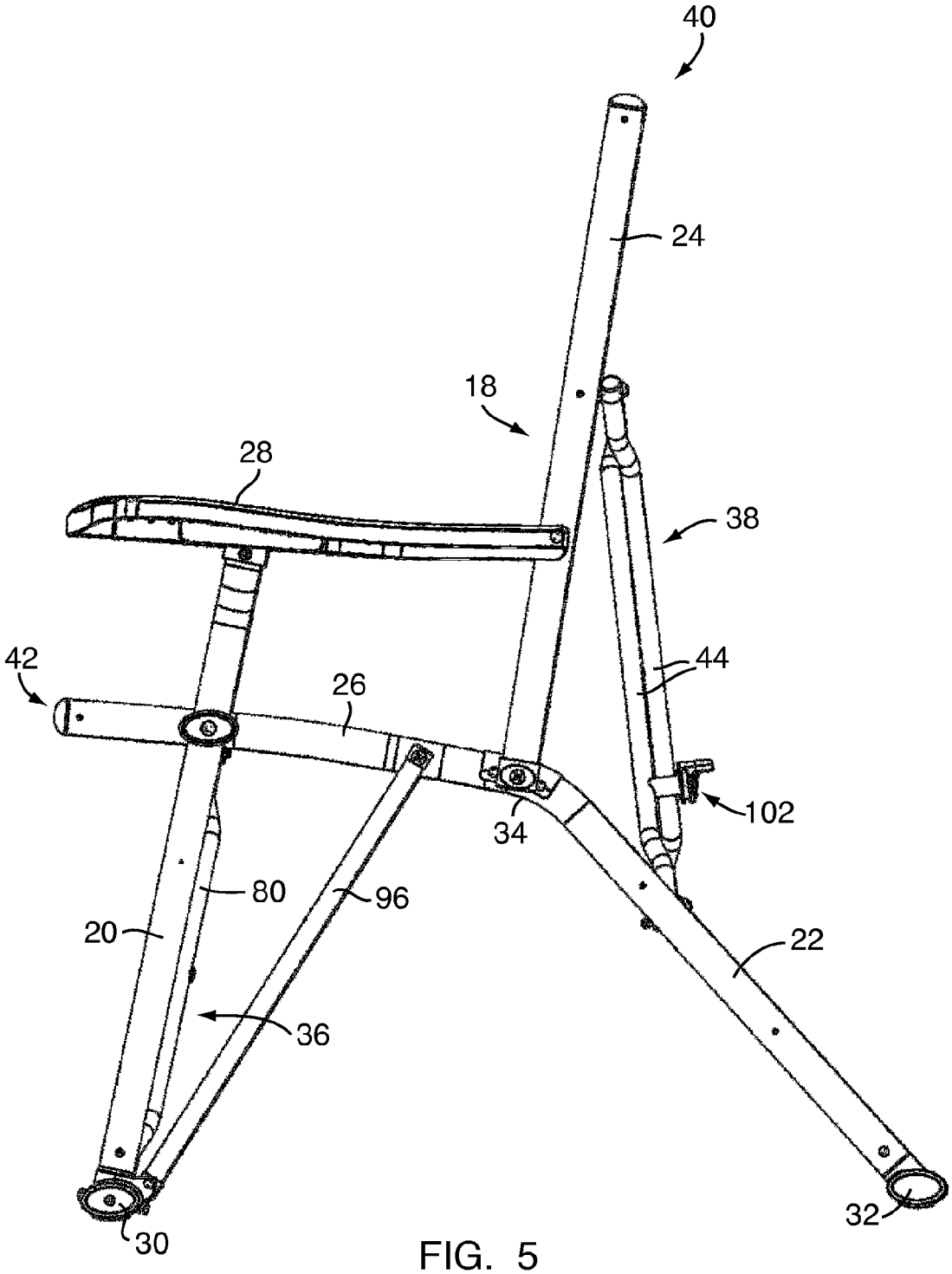
FIG. 5 is a side view of the chair design of FIG. 3, with the back support of the chair at its most forward and upright position.

The frame 12 has a pair of side assemblies comprised of frame members and having substantially identical construction, but of opposite hand, indicated generally at 18L and 18R. The left and right frame side assemblies 18L and 18R are disposed in laterally or transversely spaced apart and generally parallel relation to each other when the chair 10 is in its set-up condition. Considering now a typical frame side member assembly 18, as shown in FIG. 5, an axially elongated tubular front leg member 20, a rigid rear leg member 22, a back support member 24, a seat support member 26, and an armrest 28 are provided. Such frame members for the side frame assembly 18 are preferably disposed within generally parallelly extending vertical planes and connected each to another for pivotal movement relative to each other about generally transversely extending pivot axes. In general, respective pivot axes on the left and right side frame assemblies 18L and 18R are aligned for proper use and operation of the chair 10.

The chair frame 12 is generally adapted to rest on a generally horizontally oriented supporting surface, such as a floor or the ground, in a set-up condition. The front leg members 20 and rear leg members 24 are provided with front feet 30 and rear feet 32, respectively, for stabilizing the chair 10 on the supporting surface. In the set-up condition, the flexible seat panel 14 defines a generally taut chair seat support and the flexible backrest panel 16 defines a generally taut chair back support, for collectively accommodating an upright seated or reclined chair occupant. The seat panel 14 and the backrest panel 16 are secured to portions of the chair frame 12 that help define and provide the seat support and the back support for the occupant. In a preferred design, the rear leg member 24 also acts as a frame member for supporting the seat panel 14 of the chair 10, and thus comprises a rear portion acting as the rear leg and a forward portion acting as the seat support member 26. As shown, each rear leg member 22 includes a transition area, such as bend 34, at a location intermediate the front and back portions of the leg member 22. The transition area generally corresponds with the rear of the seat panel 14 and thus essentially defines the back of the seating area. As shown, the back support members 24 are preferably pivotally mounted to the rear leg members 22 proximate the region of the intermediate bend 34. The front leg members 20 and the rear leg members 22 are directly connected to each other for pivotal movement relative to each other about a transverse pivot axis. More particularly, the point of connection between the leg members 20 and 22 is in the upper portion of the former and in the forward portion of the latter, as shown more clearly in FIG. 5.

In alternate designs of the frame side member assembly 18, the rear portion and the forward portion of the rear leg member 22 can be independent members connected together by a fixed or flexible joint. In such a design, therefore, there would be a separate rear leg member 22 and seat support member 26. The back support member 24 can be pivotally connected to the joint, the rear portion of the seat support member 26, or the top portion of the rear leg member 22.

Figure 2:
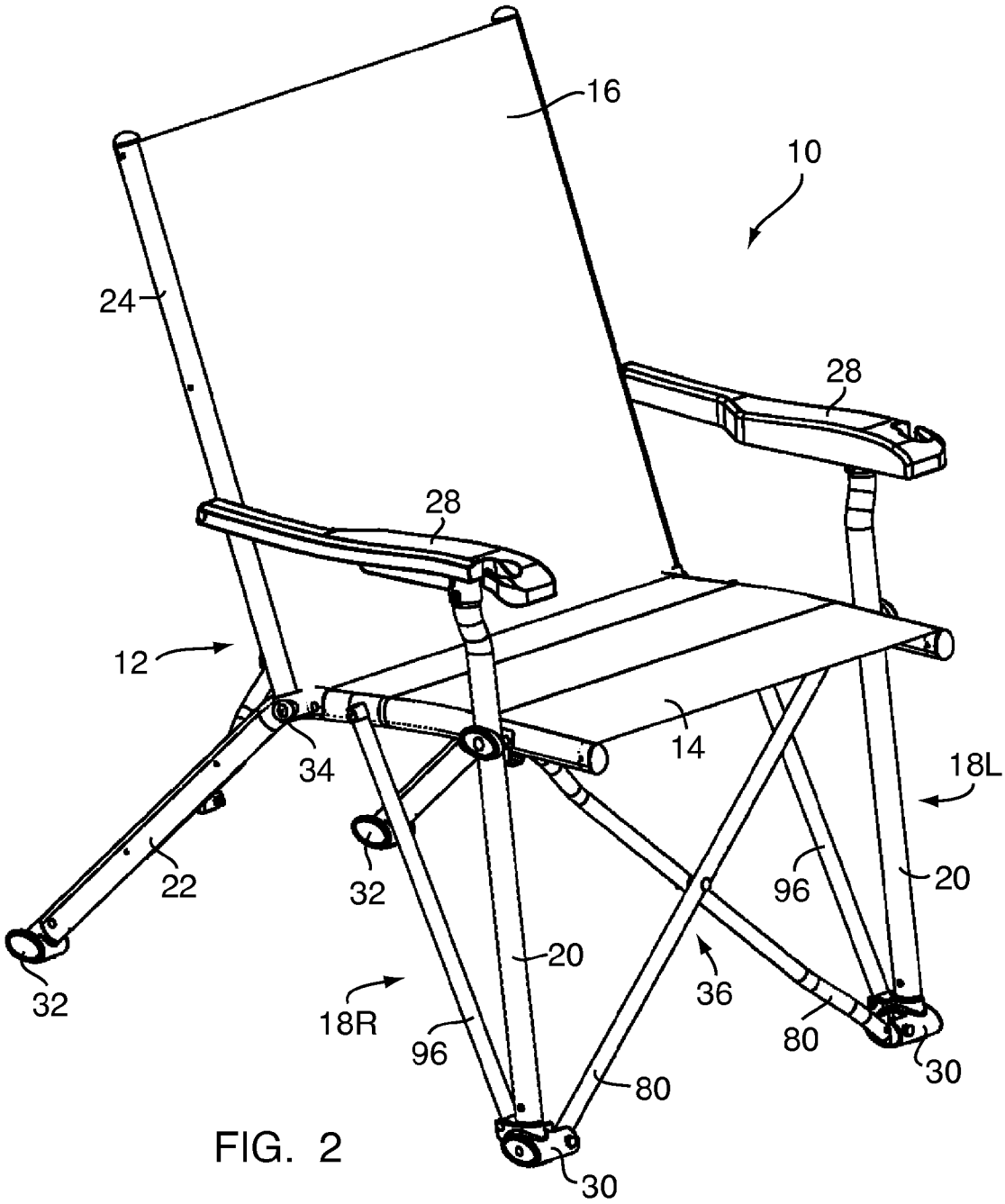
FIG. 2 is a perspective view of the unifoldable reclining chair of FIG. 1 with the back support of the chair in a reclined position.
Figure 3:
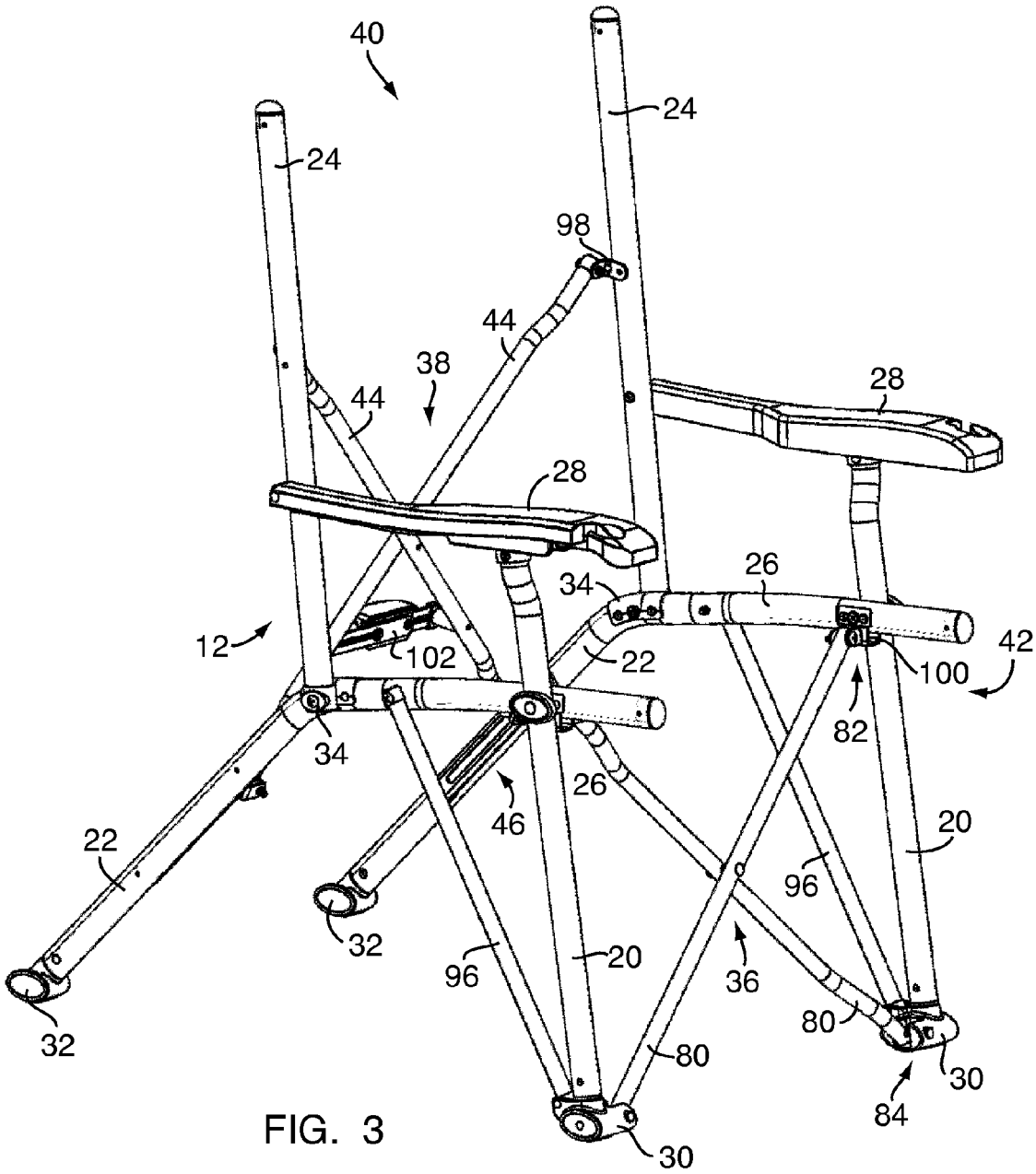
FIG. 3 is a perspective view of an embodiment of the unifoldable reclining chair design of FIG. 1 with the flexible seat support panel and the flexible backrest support panel removed.
Figure 4:
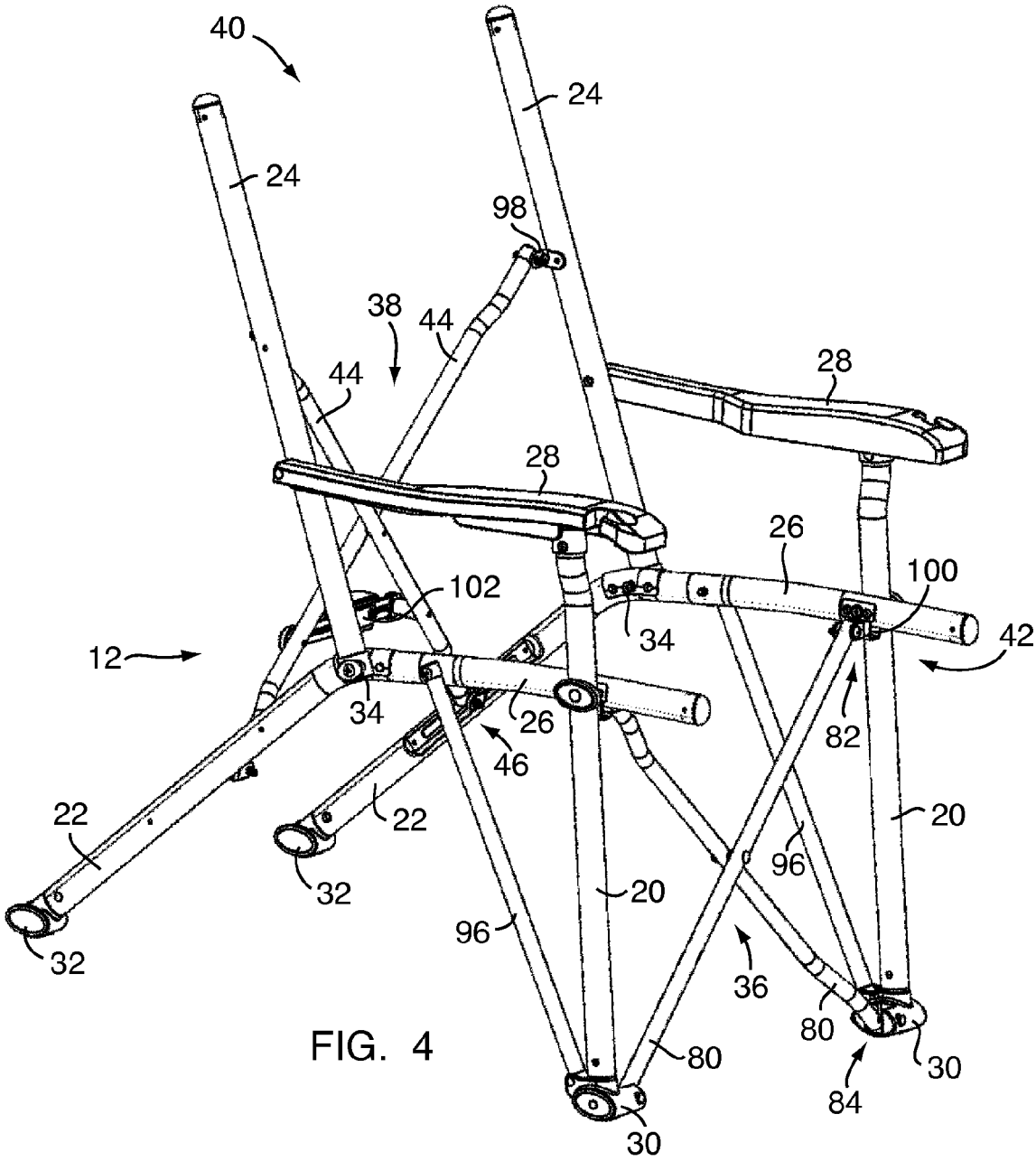
FIG. 4 is a perspective view of the chair design if FIG. 3 with the back support of the chair in a reclined position.
Figure 7:
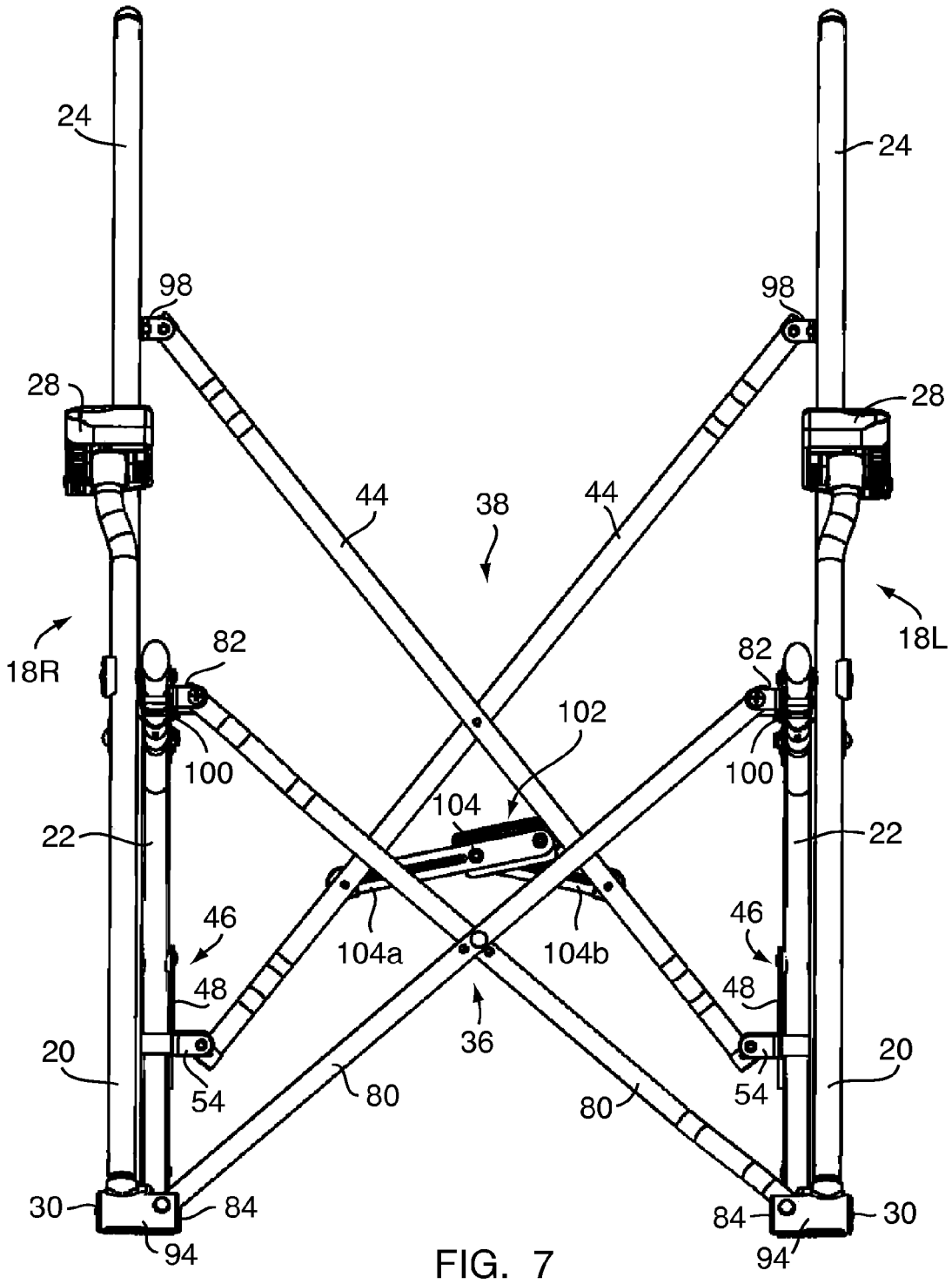
FIG. 7 is a front view of the chair design of FIG. 3.
Figure 9:
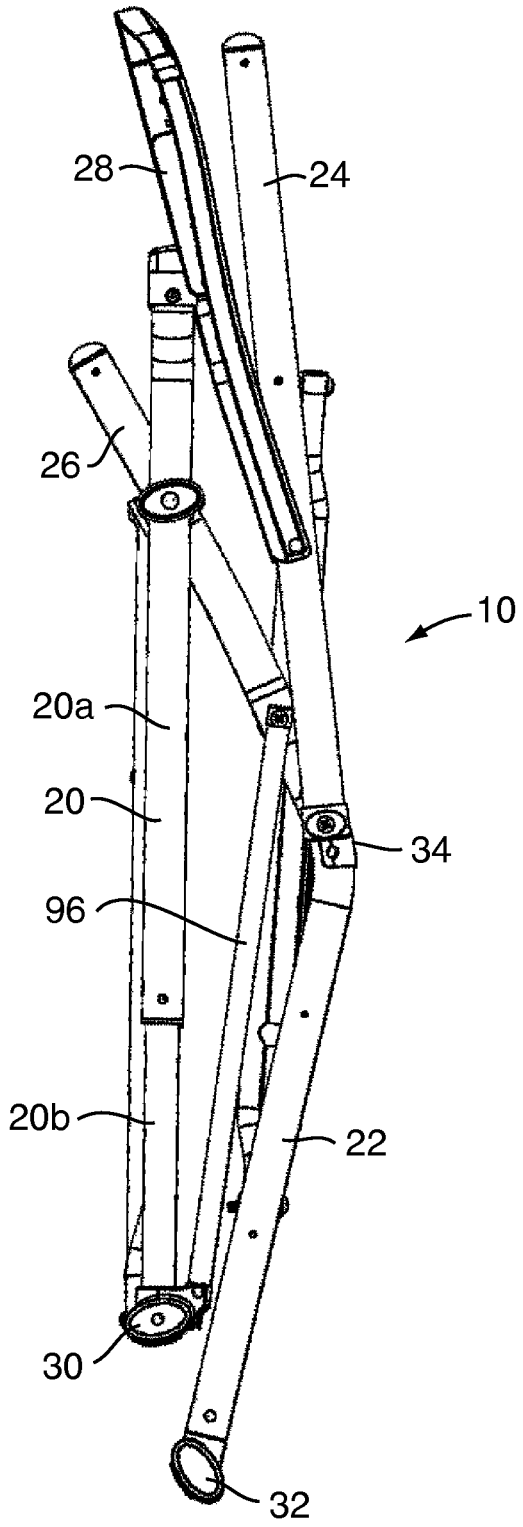
FIG. 9 is a side view of the chair design of FIG. 3 in a completely collapsed condition.
Figure 10:
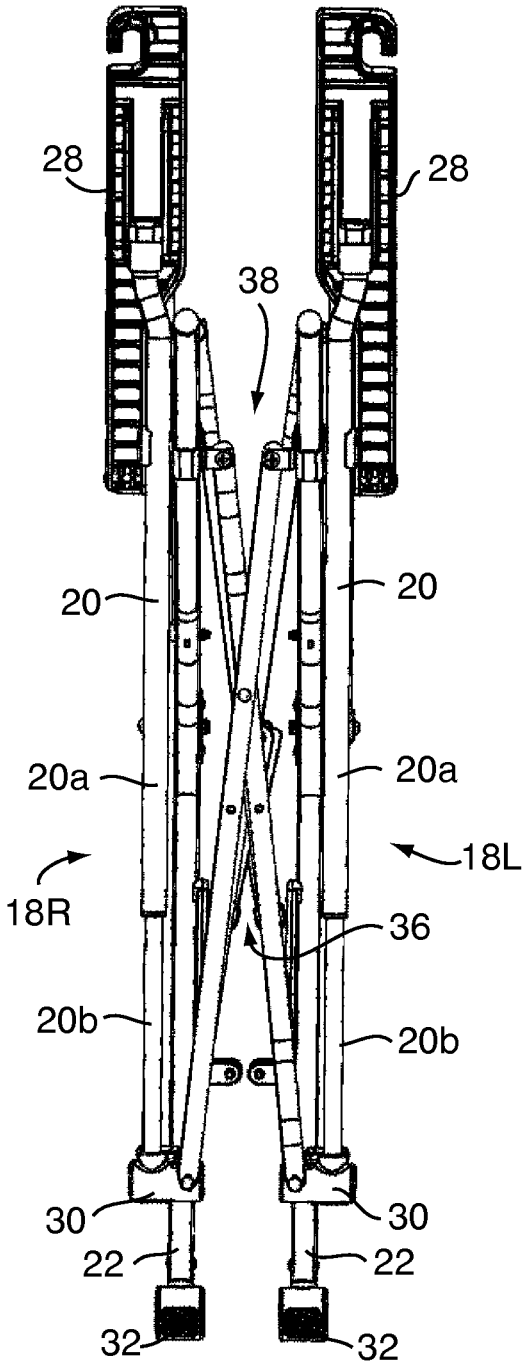
FIG. 10 is a front view of the completely collapsed chair shown in FIG. 9.
Figure 11:
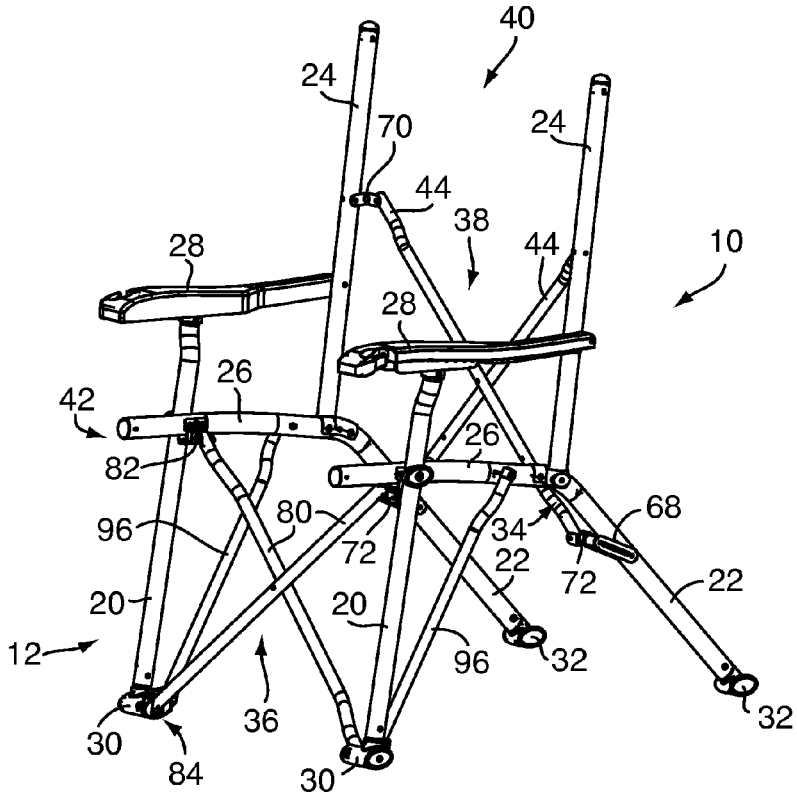
FIG. 11 is a perspective view of a unifoldable reclining chair design in accordance with an alternate embodiment of the present invention with the seat support panel and the backrest support panel removed and with the back support of the chair at its most forward and upright position.
Figure 12:
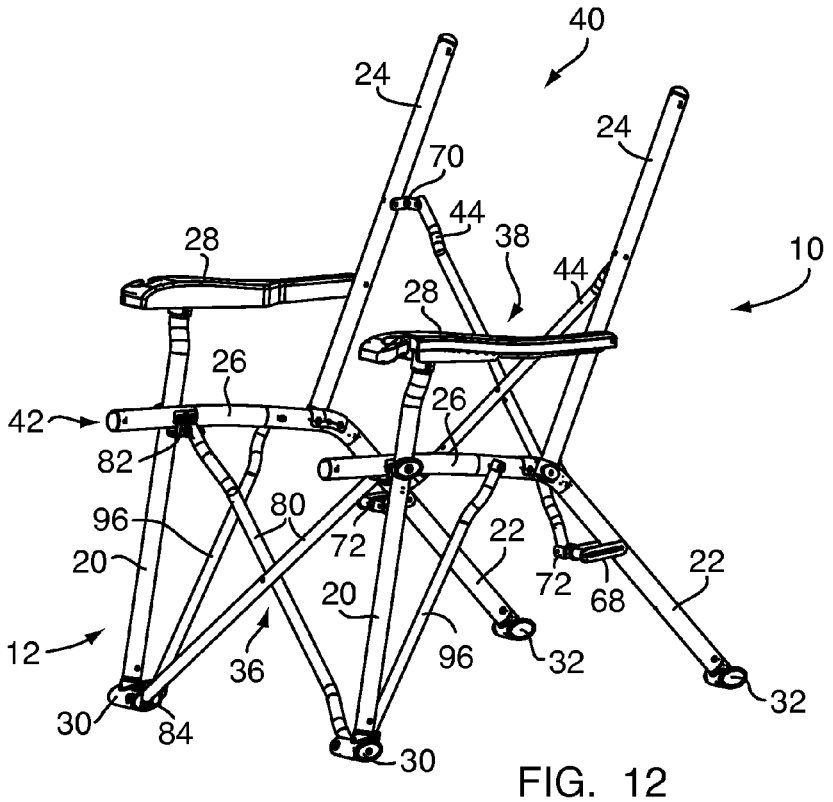
FIG. 12 is a perspective view of the unifoldable reclining chair design of FIG. 11 with the back support in a reclined position.

Referring to FIGS. 3-4 and 7, the chair frame 12 includes the pair of frame side member assemblies 18L and 18R of opposite hand. The frame side member assemblies 18L and 18R are joined each to the other, to enable, in part, transverse, or left-right, folding of the frame, by a pair of movable X-frame connector assemblies, namely a foldable front connector assembly 36 and a foldable rear connector assembly 38. As noted, the connector assemblies 36 and 38 enable and facilitate transverse folding of the chair frame 12 between an open, or set-up, condition, as shown in FIGS. 1-2, and a collapsed, storage condition, as shown in FIGS. 9-10. The connector assemblies 36 and 38 also provide support for the chair frame 12 in the open, set-up condition by balancing and redistributing the forces exerted on the chair frame 12 by a person seated on the seat panel 14 and leaning back on the backrest panel 16. It should be noted that in accordance with a "unifoldable" folding operation whereby the chair 10 of the present invention is collapsed in multiple directions to a completely collapsed condition with a single folding action, the chair 10 cannot be folded only and exclusively in the transverse direction, but that transverse folding is conducted in combination with folding of the chair 10 in other directions, such as front-back.

Figure 6:
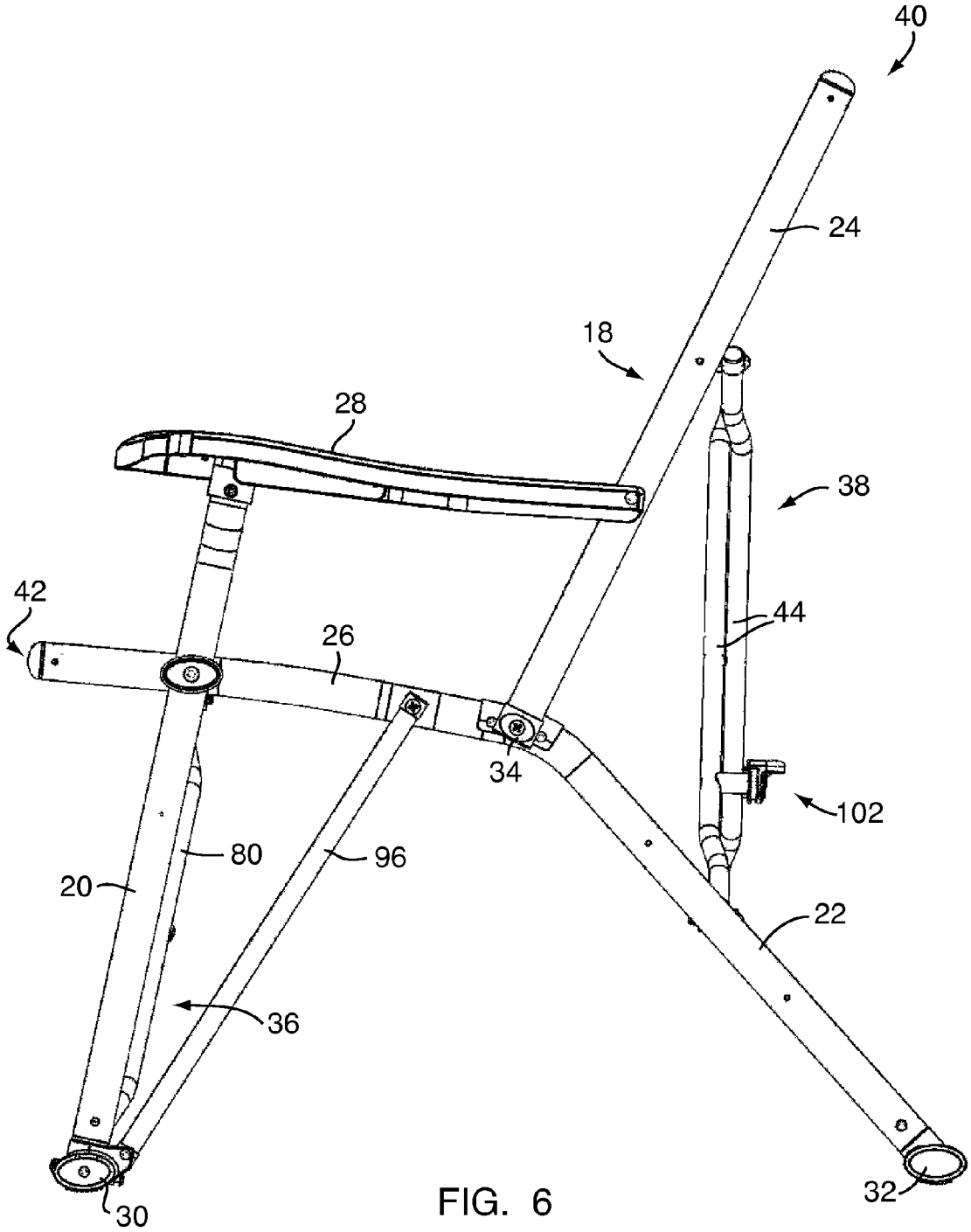
FIG. 6 is a side view of the chair design of FIG. 3, with the back support of the chair in a reclined position.

As noted above, the chair 10 of the present invention is designed so that the back support is reclinable. In FIGS. 3-6, the back support is generally designated as reference numeral 40 and a seat support is generally designated as reference numeral 42. In particular, the angle of the back support 40 relative to the seat support 42 can be adjusted to a number of reclined positions. In FIGS. 3 and 5, the chair 10 is illustrated with the back support 40 at its most forward and upright position. FIGS. 4 and 6 illustrate the chair 10 with the back support 40 reclined to its most reclined position. In accordance with the present invention, the back support 40 can be reclined to and held at any of a number of reclined positions between the most upright position (FIGS. 3 and 5) and the most reclined position (FIGS. 4 and 6). As can be seen, the rear connector assembly 38 is connected between the rear leg members 22 of the chair 10 and the back support members 24 to provide support for the back support 40 in its reclined positions. The rear connector assembly 38 comprises two transversely disposed frame connectors 44 that preferably form a pivotable X-frame, discussed in more detail below, which opens into the shape of an "X" when the chair 10 is opened to the set-up condition, and which collapses when the chair 10 is folded up. The rear X-frame connectors 44 preferably adjust position along with movement of the back support 40 so as to provide adequate support to a person sitting in the chair 10 and leaning back on the backrest panel 16.

The structure of the chair 10 enables the chair frame 12 to be adjusted between an upright seated condition and any of a number of reclined seated conditions while the chair 10 remains in its set-up condition. More particularly, the back support 40 is adapted to be reclined relative to the seat support 42 without affecting the arrangement of the front leg members 20 or the rear leg members 22. In accordance with the present invention, the rear connector assembly 38 is movably attached between the rear leg members 22 and the back support members 24 to enable and accommodate angular adjustment of the back support 40. More specifically, the rear connector assembly 38 can be pivotally, slidingly, and/or telescopically attached to the rear leg members 22 and/or the back support members 24 for movement between at least first and second positions, where such positions correspond to respective first and second reclined positions of the back support 40. Even more specifically, the back support 40 may be adjusted to one of many predefined angularly reclined positions between a forward-most upright position and a fully reclined position, whereby the positioning of the rear connector assembly 38 moves to a different position to accommodate each back support position. Various embodiments of the mechanisms for attaching the rear connector assembly 38 to the back leg members 22 and the back support members 24, and for adjusting the positioning of the rear connector assembly 38 are discussed hereinafter.

Figure 8A:
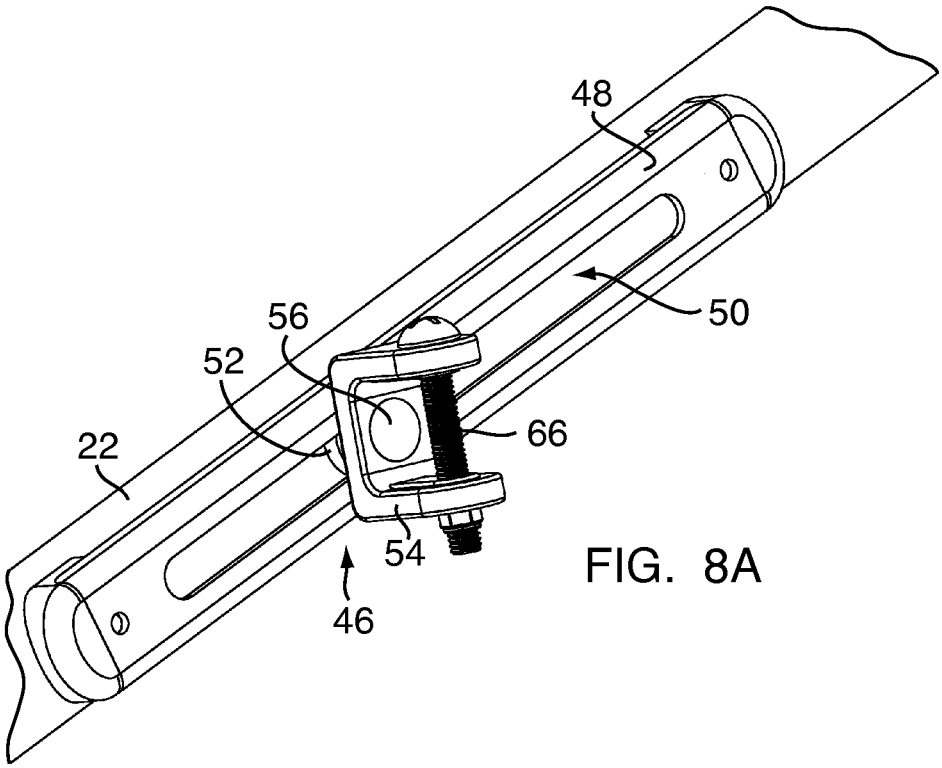
FIG. 8A is a partial perspective view of a guide rail assembly used in the chair design of FIG. 1 for enabling and accommodating reclining adjustment of the back support.
Figure 8B:
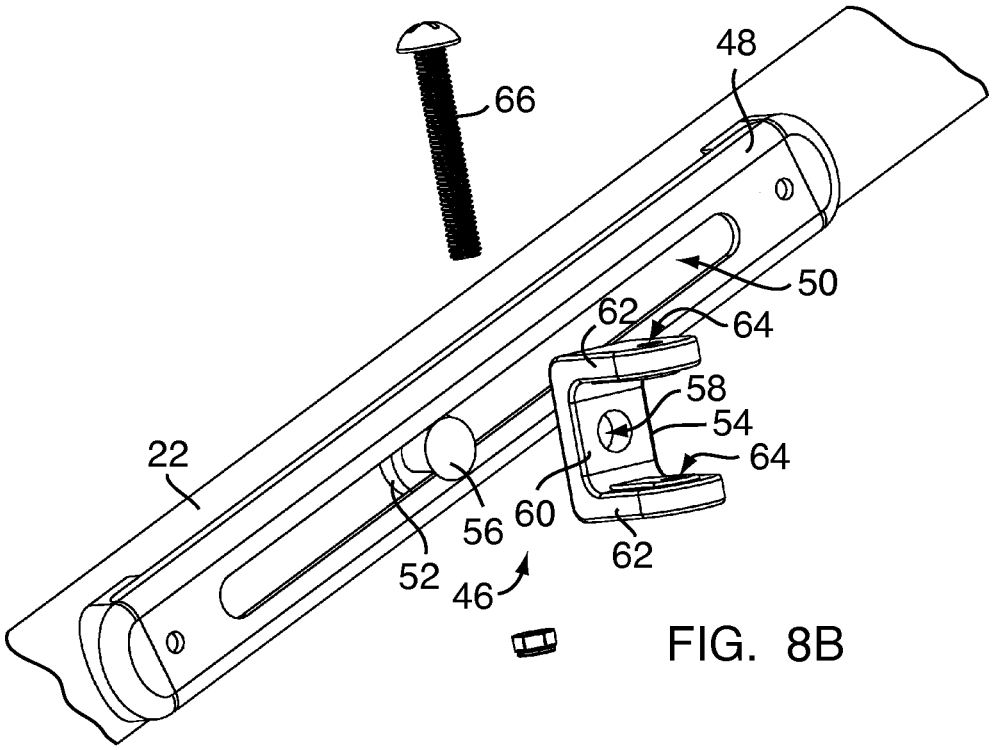
FIG. 8B is an explode view of the guide rail assembly of FIG. 8A.

FIGS. 8A and 8B illustrate a preferred means for enabling adjustment of the back support 40 without affecting the set-up condition of the chair 10. A guide rail assembly, general designated as reference numeral 46, comprises a guide rail 48 preferably mounted on the inwardly facing side of the rear leg member 22 and defining a slot 50, and a slide 52 disposed within the slot 50 of the guide rail 48 for movement along the length of the guide rail 48. Preferably, the slide 52 has a complementary shape to the slot 50 to facilitate the movement of the slide 52 within the guide rail 48 during reclining of the back support 40 as well as during set-up and collapsing of the chair 10. A generally U-shaped "universal" mounting bracket 54 is pivotally attached to the slide 52 and is adapted to receive the lower terminal end of a rear connector 44 for pivoting relative to the slide 52, thereby providing first means for adjusting the position of the rear connector 44 relative to the rear leg member 22. As shown in FIG. 8A, the mounting bracket 54 is pivotally mounted on the inwardly facing side of the slide 52 by a pin fastener 56 that forms part of the slide 52 once assembled. The pin fastener 56 passes through an opening 58 in the throat 60 of the bracket 54, as shown more clearly in FIG. 8B. Outwardly extending ears 62 on the mounting bracket 54 have apertures 64 for receiving a pivot pin 66 for securing the terminal lower end of the connector 44 to the mounting bracket 54. Accordingly, when the back support 40 is reclined by the user in a manner to be described below, the slide 52 moves along the guide rail 48 and the connector 44 pivots relative to the slide 52 to enable and accommodate the adjustment of the back support 40 without affecting the positioning of the rear leg member 22 or any other stationary portion of the chair frame 12.

The movement of the slide 52 relative to the guide rail 48 is generally illustrated in FIGS. 3 and 4. For example, in FIG. 3, which corresponds to a set-up condition of the chair 10 with the back support 40 at its most forward and upright position, the slide 52 is shown at a first position, generally at the top of the guide rail 48. As the back support 40 is reclined, the slide 52 begins to slide downwardly within the slot 50 along the length of the guide rail 48. In FIG. 4, which corresponds to a set-up condition of the chair 10 with the back support 40 at its most reclined position, the slide 52 is shown at a second position. Thus, the slide 52 moves between its first position and its second position along the guide rail 48 as the back support 40 is moved to relative reclined positions. Inasmuch as the back support 40 can be reclined to and held at any of a number of reclined positions, the slide 52 will move to a corresponding location to accommodate and support the reclined position of the back support 40. The slide 52 also moves with respect to the guide rail 48 when the chair frame 12 is being set-up and collapsed.

In another embodiment of the present invention shown in FIGS. 11-14, the support frame connectors 44 between the rear leg members 22 and the back support 40 are pivotally connected at one end to the back support members 24 and at the other end to linkages 68 pivotally connected to the rear leg members 22. More particularly, as the back support 40 is reclined backwards, each linkage 40 pivots downward, thereby providing second means for adjusting the positions of the support frame connectors 44 relative to the rear leg members 22. The upper terminal ends of the frame connectors 44 are pivotally attached to the back support members 24 via generally U-shaped "universal" mounting brackets 70. Though permitting pivoting movement of the connectors 44 relative to the back support members 26, the mounting brackets 70 are fixed in location on the back support members 26. The lower terminal ends of the frame connectors 44 are pivotally attached to the linkage 68 via generally U-shaped "universal" mounting brackets 72. The mounting brackets 70 and 72 have the same general design as mounting bracket 54 described above and shown in FIGS. 8A and 8B. As the back support 40 is reclined, the frame connectors 44 pivot relative to the linkage 68—which is pivoting downward—to maintain requisite structural integrity for the back support 40 and to brace the chair frame 12 in the reclined position. The linkages 68 also pivot with respect to the rear leg member 22 when the chair frame 12 is being set-up and collapsed.

Figure 13:
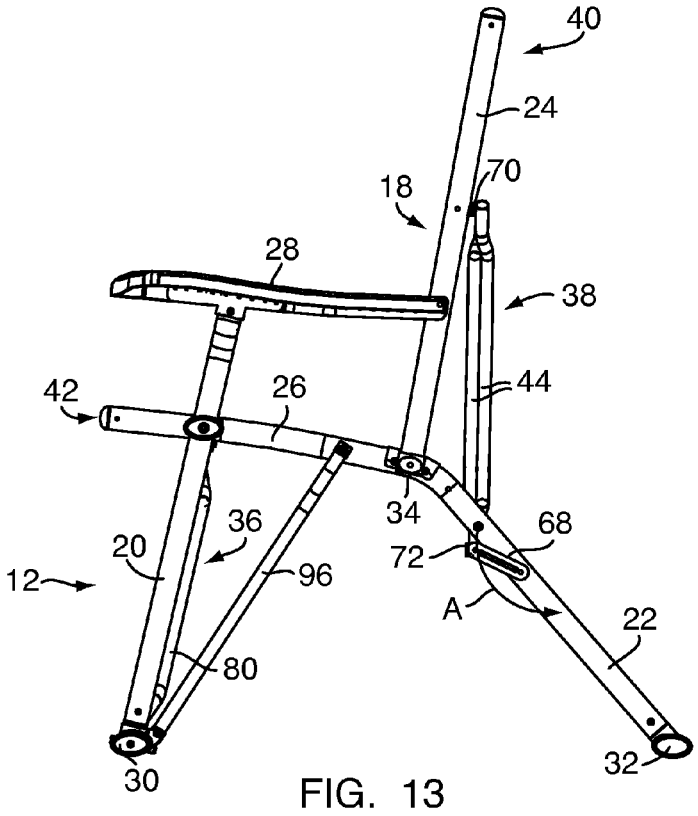
FIG. 13 is a side view of the chair design of FIG. 11.
Figure 14:
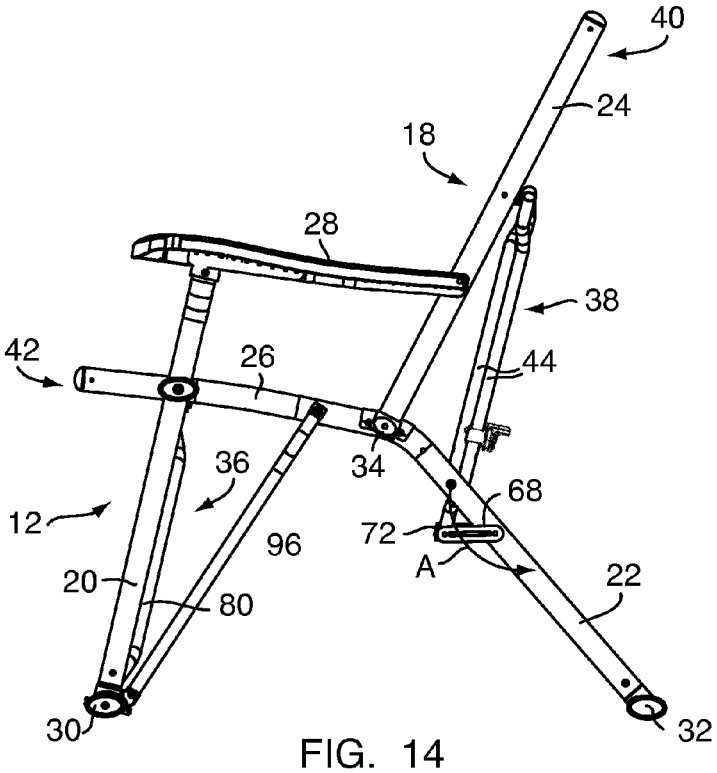
FIG. 14 is a side view of the chair design of FIG. 12.
Figure 15:
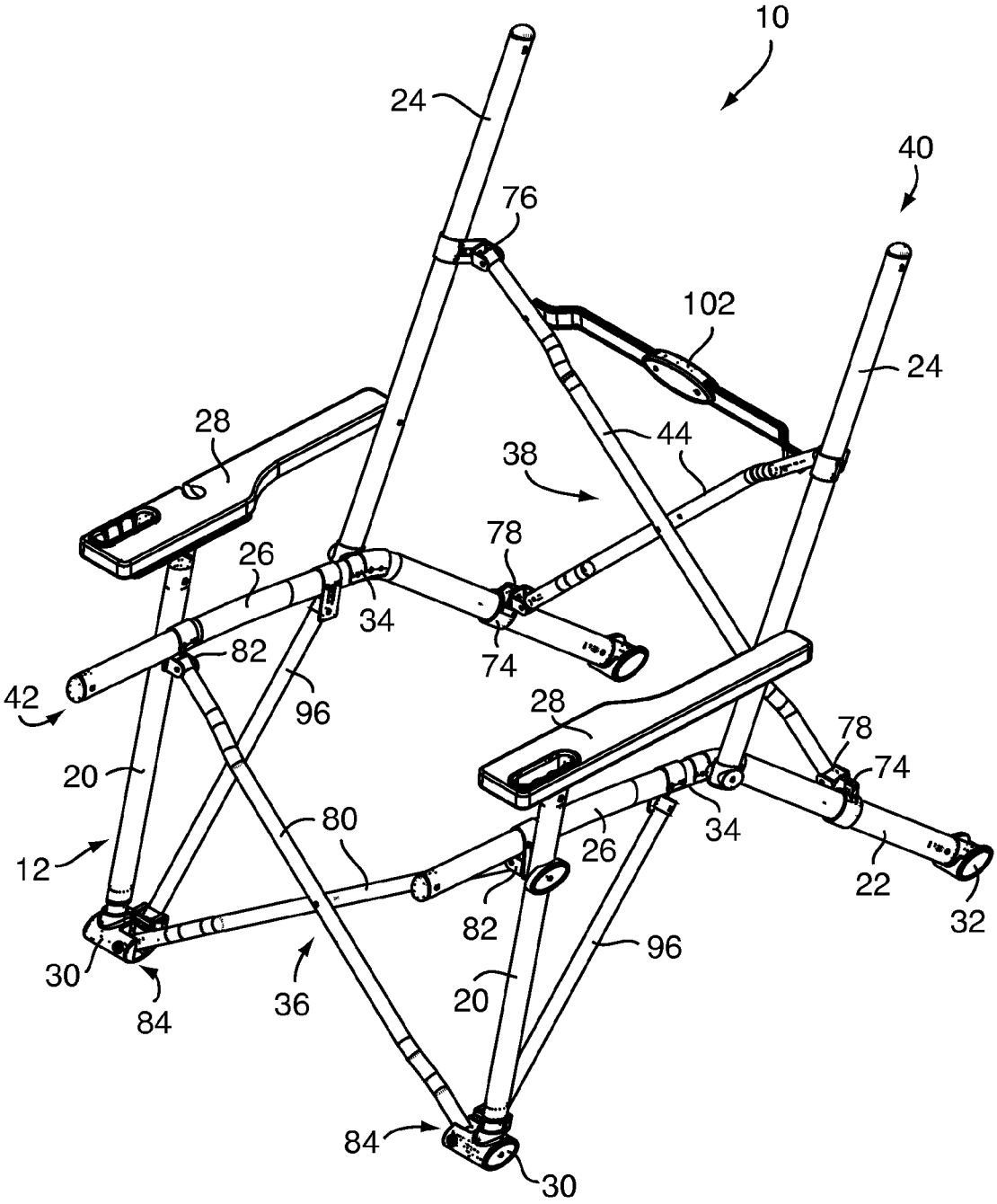
FIG. 15 is perspective view of a unifoldable reclining chair design in accordance with an alternate embodiment of the present invention with the seat support panel and the backrest support panel removed and with the back support of the chair at its most forward and upright position.
Figure 16:
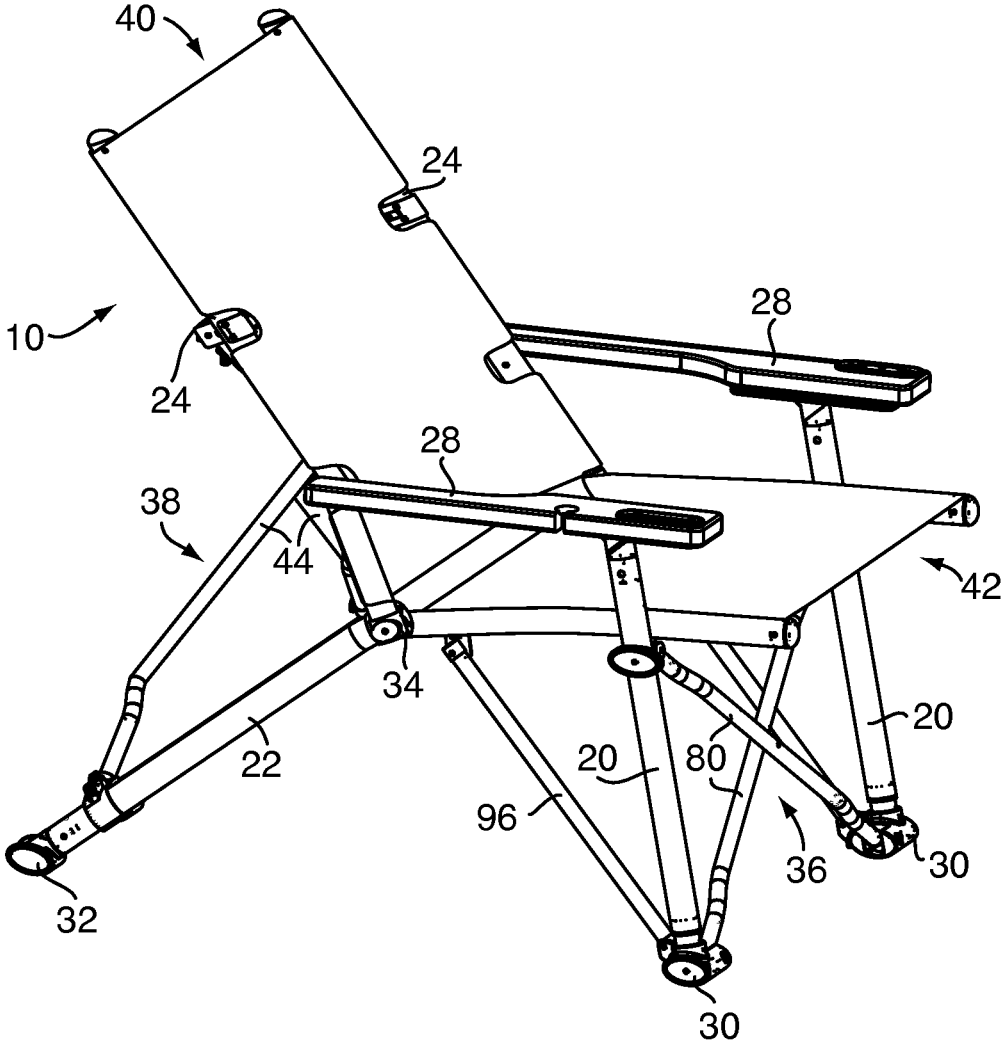
FIG. 16 is a perspective view of the unifoldable reclining chair design of FIG. 15 with the back support in a reclined position.
Figure 17:
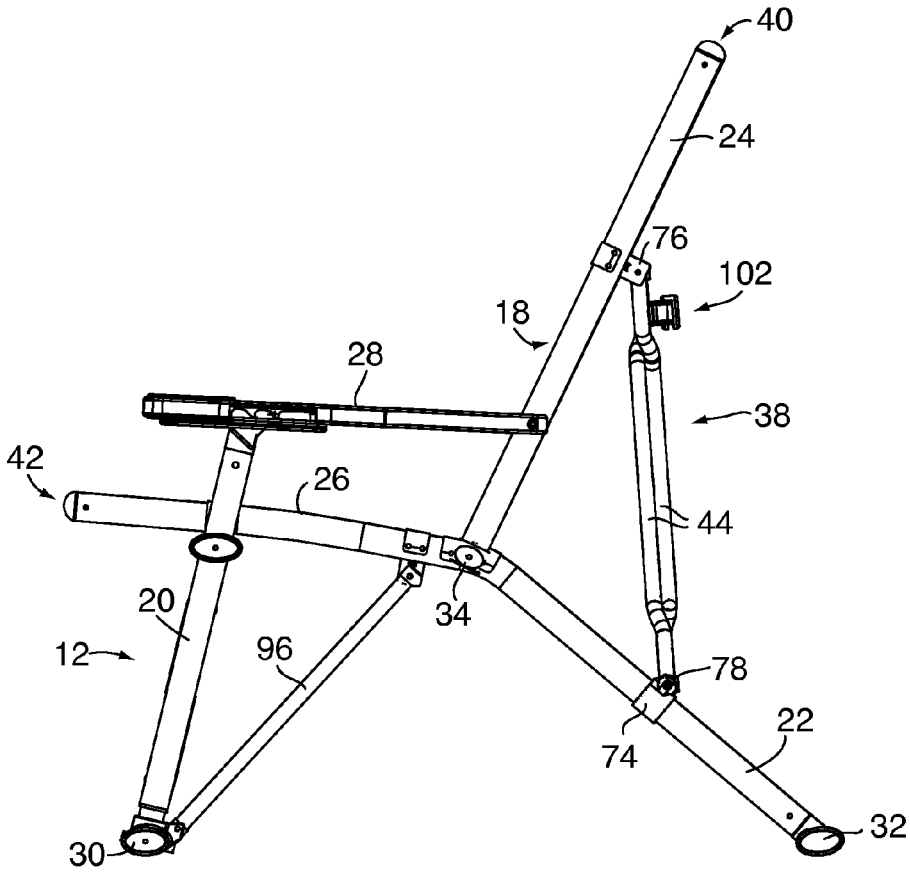
FIG. 17 is a side view of the chair design of FIG. 15.
Figure 18:
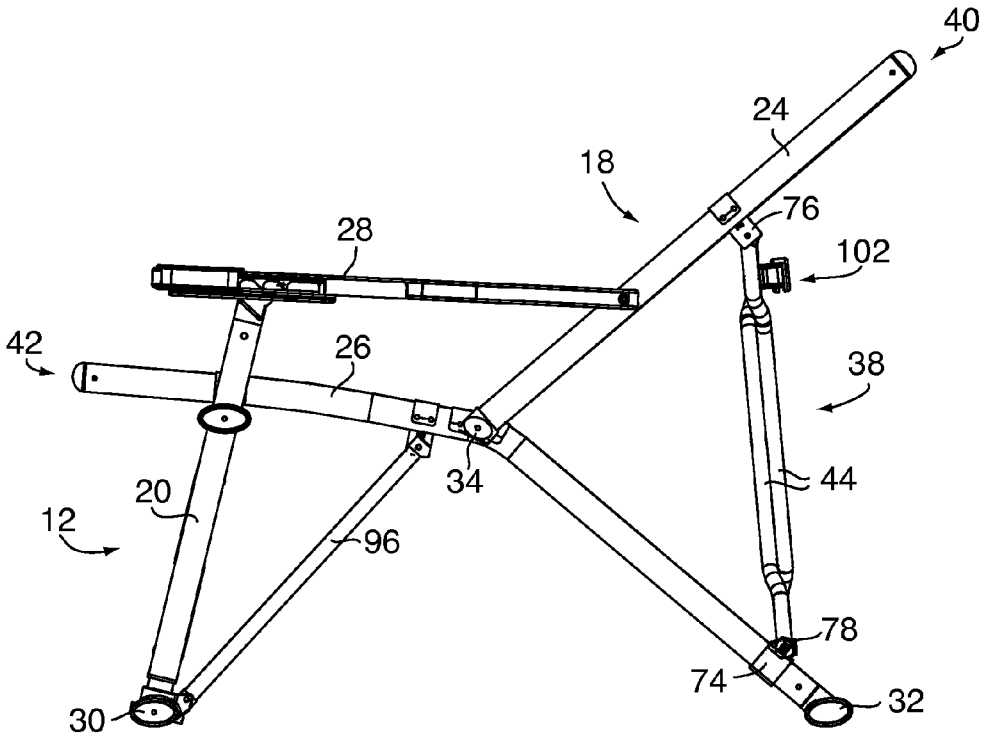
FIG. 18 is a side view of the chair design of FIG. 16.

The movement of the linkage 68 is generally illustrated in FIGS. 13 and 14. For example, in FIG. 13, which corresponds to a set-up condition of the chair 10 with the back support 40 at its most forward and upright position, the linkage 68 is shown at a first position. As the back support 40 is reclined, the linkage 68 on each side of the frame 12 begins to pivot downwardly along the path illustrated by arrow A. In FIG. 14, which corresponds to a set-up condition of the chair 10 with the back support 40 at its most reclined position, the linkage 68 is shown at a second position. Thus, the linkage 68 moves between its first position and its second position along the path of arrow A as the back support 40 is moved to relative reclined positions. Inasmuch as the back support 40 can be reclined to and held at any of a number of reclined positions, the linkage 68 will pivot to a corresponding location to accommodate and support the reclined position of the back support 40. Though shown as pivoting under the rear leg member 22, the linkage 68 can be mounted for pivoting above the rear leg member 22 without departing from the spirit and principles of the present invention. In such an alternate design of the linkage set-up, the linkage 68 will pivot with reclining movement of the back support 40 along a path generally mirroring that illustrated by arrow A.

In accordance with still another embodiment of the present invention as shown in FIGS. 15-18, the rear frame connectors 44 between the rear leg members 22 and the back support 40 may alternatively be pivotally connected to the back support 40 at one terminal end and slidably mounted to the rear leg members 22 at the other terminal end. More particularly, the frame connectors 44 may be pivotally attached to sleeves or collars 74 slidingly mounted on the rear leg members 22. As the back support 40 is reclined backwards, the sleeves 74 slide downward along the rear leg members 22 towards the rear feet 32 and the frame connectors 44 pivot on both the sleeves 74 and on the back support members 24 via generally U-shaped "universal" mounting brackets 76 and 78 to brace the chair frame 12 in the reclined position. The sleeves 74 also slide along the rear leg member 22 when the chair frame 12 is being set-up and collapsed to accommodate pivoting movement of the rear leg members 22 relative to the other frame members and frame connectors of the chair frame 12.

Further alternate designs may be used to support the back support 40 in a reclined position. For example, the rear frame connectors 44 can be pivotally connected, but fixed in location, to the rear leg members 22 and slidingly connected to the back support members 24. Alternatively, the frame connectors 44 can have telescoping sections and be pivotally mounted at both ends to fixed locations on the rear leg members 22 and the back support members 24, respectively, whereby reclining of the back support 40 would cause the frame connectors 44 to pivot at each end and telescope to accommodate and support the selected angular position of the back support 40.

The front leg members 20 of the chair frame 12 are preferably formed by a pair of axially elongated telescopically connected front leg sections 20*a* and 20*b*. When the chair 10 is in its set-up condition each telescopic front leg member 20 extends in a generally upward direction. The forward portion of the rear leg member 22, acting as the seat support member 26, extends essentially horizontally back from the connection point with a respective front leg member 20 to the intermediate bend 34. The rear portion of the rear leg member 22 is downwardly and rearwardly inclined from the intermediate bend 34. Pivoting of the front leg members 20 relative to the rear leg members 22 enables folding of the chair frame 12 in a front-back direction, as shown in FIG. 9. When the chair 10 is so collapsed, each front leg member 20 telescopes outwardly, as generally shown in FIGS. 9-10, so that the chair frame 12 can be collapsed tightly without the length of the front leg 20 inhibiting inward folding motion as is the case with a front leg having fixed dimension. It should be noted that in accordance with a unifolding operation in accordance with the present invention, whereby the chair 10 can be folded in multiple directions to a completely collapsed condition with a single folding action, the chair 10 cannot be folded only and exclusively in the front-back direction, but that front-back folding in conducted in combination with folding of the chair 10 in other directions, such as transversely, or side-to-side.

Referring further to FIGS. 3-4 and 7, the front connector assembly 36 comprises axially elongated front connectors 80 that are each attached to both the right and left front legs 20, which comprise part of the frame side assemblies 18L and 18R. The upper terminal end of each of the front frame connectors 80 is pivotally connected to an associated front leg member 20 by a pivot mount fitting 82 mounted in fixed position on the front leg member 20. Each mount fitting 82 extends inwardly immediately below the front-end portion of an associated seat portion of the rear leg member 22. The upper terminal end of each of the front connectors 80 is secured by an associated pivot pin to pivot on an associated mount fitting 82. The lower terminal end of each of the front connectors 80 is secured in a recess 84 defined by the front foot 30 mounted in a fixed position on the lower end of the lower telescoping leg member 20*b*. Each sliding leg member 20*b* is telescopically coaxially received in the lower end of the associated upper front leg member 20*a* to slide within and relative to that leg member 20*a* based, in part, on forces exerted by the front frame support connectors 80 during collapsing of the chair 10, as best shown in FIGS. 9-10 and for a purpose to be hereinafter evident.

Alternate designs for the leg members 20 and 22 can be used without departing from the focus of the present invention. For example, in the preferred embodiment shown, the rear leg members 22 extend to form the seat support member 26 of the frame 12 for the seating portion of the chair 10. Indeed, the seat panel 14 is attached to the rear leg members 22 to support a person using the chair 10. In alternate designs, the seat support member 26 can be a separate piece from the rear leg member 22. The two members 22 and 26 can be rigidly attached to each other, or flexibly attached to each other to provide some give to accommodate the person's weight when seated on the seat panel 14.

Referring back to FIGS. 5-6, each of the frame side member assemblies 18L and 18R also includes the axially elongated back support member 24 for supporting the backrest panel 16. Each back support member 24 is pivotally mounted on an associated rear leg member 22 proximate the intermediate bend 34 thereon. The back support members 24 are capable of adjustment when the chair 10 is in a set-up condition—i.e., with the seat support 42 generally horizontally disposed—so that the back support 40 and the backrest panel 16 can be reclined to a desired position. When the back support 40 is reclined, the seat support 42 and the seat panel 14 remain in position—i.e., essentially horizontal. Accordingly, when the back support 40 is reclined, the angular relationship between the seat support 42 and the back support 40 changes without affecting the set-up condition of the chair 10. The various frame members and connector members discussed above, their arrangement relative to one another, and their means of interconnection, be it fixed, pivoting, sliding or telescoping, permit the chair 10 to be stable in its set-up condition while permitting easy adjustment of the back support 40 to various reclined positions.

Figure 19A:
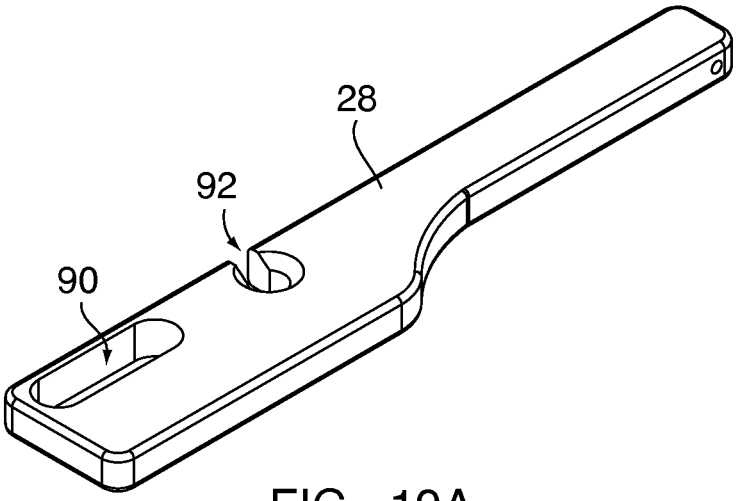
FIG. 19A is a perspective view of an embodiment of an armrest design for use with a unifoldable reclining chair design in accordance with the present invention.
Figure 19B:
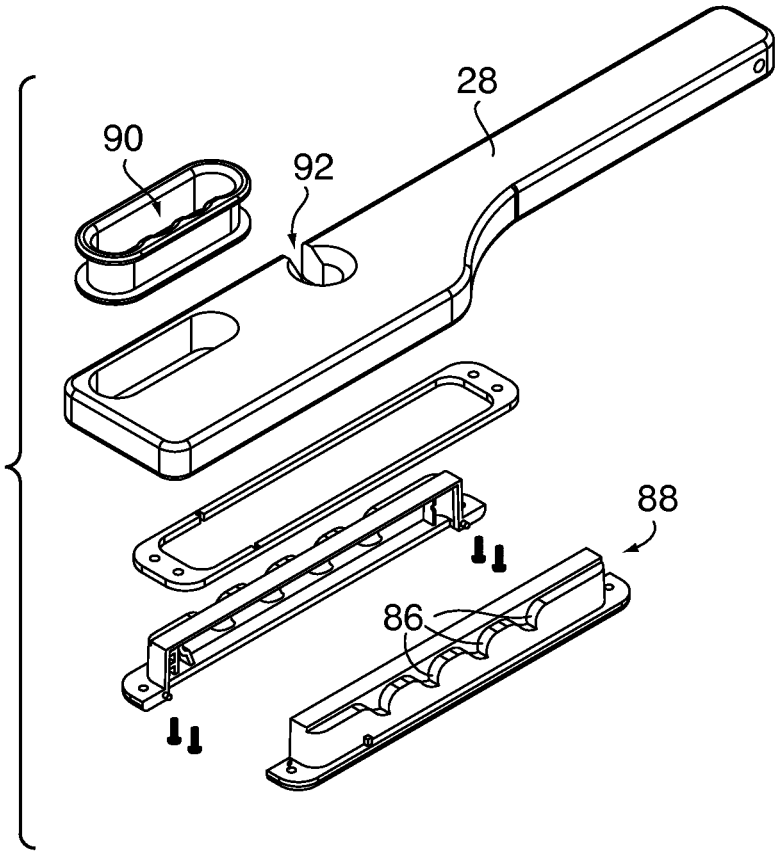
FIG. 19B is an exploded perspective view of the armrest design of FIG. 19.

Adjustment of the back support members 24 is enabled by the armrests 28, the rear ends of which are pivotally mounted to an associated back support member 24 and the forward ends of which interact with the top of an associated front leg member 20 in a preferred design. An exemplary armrest 28 for use with the present invention is shown in FIGS. 19A and 19B. In a preferred embodiment of the armrest 28, the forward portion of each armrest 28 is provided with notches 86—e.g., a plate 88 carried by the armrest 28 defines a downwardly open series of sawtooth notches 86—associated with desirable angularly reclined positions of the back support 40. The top of the front leg member 20 preferably has a projection (not shown) adapted to engage the notches 86 in the armrest 28. When so engaged, the positions of the back support 40 and backrest panel 16 are secured so that they cannot slip under the weight of a user sitting in the chair 10. To adjust the positions of the back support 40 and the backrest panel 16, the armrest 28 is lifted to disengage the projection of the front leg member 20 from the notch 86 in which it had been residing. The armrest 28 may be moved forward or backwards while the user is seated in the chair 10 to adjust the reclined positions of the back support 40 and the backrest panel 16 accordingly. When a desired position for the back support 40 is selected, the armrest 28 is moved downward so that the projection of the front leg member 20 engages the closest notch 86 in the armrest plate 88 to secure the back support 40 at the selected reclined position. Continued downward force on the armrest 28, be it by the user resting her arms on the armrest 28 or merely by the action of gravity when the chair 10 is in its set-up condition, maintains the engagement between the projection and the notch 86 in which it is residing and prevents incidental forward and backward movement or slipping of the armrest 28 that would affect the reclined position of the back support 40.

As shown in FIGS. 19A and 19B, the armrest 28 may be generally planar, and can also include a handgrip 90 and a stem glass holder feature 92. A forward portion of the armrest 28 can also be inwardly projecting to provide added support for a seated user's arms. The armrest 28 shown in FIGS. 19A and 19B can be constructed from wood, plastic or a lightweight metal. Alternate designs of the armrest may be used without departing from spirit and principles of the present invention. For example, an alternate armrest design is shown in FIGS. 1-2, where the armrest 28 is preferably constructed from a plastic or lightweight metal, such as aluminum. This design includes a stem glass holder feature 92 as well. Another alternate design of the armrest 28 may provide multi-planar support surface, which may allow for use of a longer armrest without affecting the size of the collapsed chair 10. The armrest 28 may also be constructed from a molded plastic to facilitate various contoured or multi-planar designs as desired.

Further considering the front and back X-frame connector assemblies 36 and 38 and the manner in which these assemblies are connected to the frame side member assemblies 18L and 18R, the front X-frame connector assembly 36 includes a pair of axially elongated tubular connectors 80 generally centrally joined each to the other for limited pivotal movement about a pivot axis. As shown for example in FIG. 15, each of the tubular connectors 80 may have offset central portions 80*a*—one forwardly offset, the other rearwardly offset—so that all the terminal end portions in the connector assembly 36 may be generally planar. Alternatively, one of the tubular connectors 80 may comprise a substantially axially straight member whereas the terminal end portions of the other connector member 80 are offset so that the axes of the four end portions of the front X-frame connector assembly 36 lie within a common plane for attachment to the chair frame 12, as generally shown in FIGS. 3-4.

As noted above, each leg 20 and 22 has a foot 30 or 32 mounted in fixed position thereon. As shown in FIG. 7, each front foot 30 extends for some distance inwardly toward the corresponding foot on the transversely opposite leg. The lower terminal end of each of the front X-frame connectors 80 is pivotally connected to an inwardly projecting portion 94 of an associated one of the feet 30. As shown in FIG. 3, an extra support member 96 can be provided on each side of the chair frame 12 connecting each forward leg member 20 to the seat support portion 26 of the rear leg member 22. More particularly, one end of the support member 96 is pivotally connected to the backside of the inwardly projecting portion 94 of an associated one of the front feet 30. The other terminal end is pivotally connected to an associated rear leg member 22 at a position along the seat support portion 26 thereof between the forward end and the intermediate bend 34 of the rear leg member 22.

Most of the pivotal connections to the chair frame 12 are to brackets or fittings rigidly secured to the chair frame 12. For example, in the embodiment shown in FIGS. 1-10, the terminal ends of the rear X-frame connectors 44 are pivotally connected at each end to frame members by way of mounting brackets 54 and 98. The ends of the front X-frame connectors 80 are likewise pivotally connected to the chair frame 12 by way of mount fitting 82 on the upper end and foot recess 84 on the lower end. Similarly designed brackets and fittings are utilized in the embodiments shown in FIGS. 11-14 (using linkage 60) and 15-18 (using sleeve 74). The various movable connections for the chair frame 12 herein discussed are provided by the mounting brackets and fittings, which may be molded from a suitable durable plastic material or cast from metal and which allow necessary folding and unfolding movement of the various movable parts of the chair 10 as discussed.

The mount fittings 82 for the upper end of each of the front X-frame connectors 80 are mounted in fixed position at the pivotal connection spot between the front leg members 20 and the rear leg members 22, as shown for example in FIG. 3. Each mount fitting 82 extends inwardly for some distance in the direction of the corresponding mount fitting 82 fixedly attached to the opposite side of the frame 12. As with the mounting brackets 54 used for pivotally connecting the rear X-frame connectors 44 to the guide rail assembly 46, the mount fittings 82 may include generally U-shaped "universal" mounting brackets adapted to receive the upper terminal ends of the front X-frame connectors 80 for pivoting. The mounting bracket is pivotally mounted on an inwardly facing surface of a saddle 100 at the pivotal connection spot by an associated pivot fastener that passes through an opening in the throat of the bracket, as well as the saddle 100, the front leg member 20 and the rear leg member 22, to support the bracket to pivot about a inwardly extending pivot axis relative to the saddle 100 that carries it. The pivot axis for the mounting bracket is also the pivot axis for the front leg member 20 relative to the rear leg member 22. As with the design of the mounting bracket 54 discussed above, outwardly extending ears on the mounting bracket have apertures for receiving a pivot pin for securing a terminal upper end of an associated one of the connectors 80 that comprise the front X-frame connector assembly 36.

Further, and as previously noted, in a preferred embodiment, each front leg 20 comprises a telescopic assembly that includes an upper section 20*a* and a lower section 20*b*, as best shown in FIGS. 9-10. Each lower telescoping section 20*b* is received at the lower end within an associated front foot 30 and is movable between an extended position wherein it projects for some distance from the upper front leg section

20*a* and a refracted position wherein it is substantially disposed within the associated upper front leg section 20*a*. In an alternate design, the telescoping front leg design can be replaced by a two-piece front leg assembly, where a first frame support member extends from the front foot 30 to the back part of the seat support 42 and a second frame member extends from the forward portion of the armrest 28 to a sleeve or collar slidingly mounted on the first frame member. In each embodiment of the chair design, the lower end of each of the front X-frame connectors 80 are pivotally mounted to a front foot 30 or the front leg member 20 proximate to the front foot 30. In a preferred design illustrated in FIG. 3, the inward projecting portion 94 of the front foot 30 includes a recess 84 defining a mount fitting for receiving the lower terminal end of a corresponding front connector 80. The front connector 80 is held in place for pivoting movement by a pivot pin extending through the foot 30, as shown in FIG. 7.

As previously discussed, the rear X-frame connector assembly 38 includes a pair of axially elongated tubular connectors 44 generally centrally joined each to the other for limited pivotal movement about a pivot axis. Like the front X-frame connector assembly 36, the connectors 44 of the rear X-frame connector assembly 38 are centrally pivotally connected for pivotal movement between an open position wherein the connectors 44 cross each other and present an X-shaped configuration and a closed position wherein the connectors 44 are in near side-by-side relation to each other. As shown in FIG. 3, the upper terminal ends of the rear frame connectors 44 can be pivotally attached via a pivot fastener to a generally L-shaped mounting bracket 98 secured to the backrest support member 24.

Alternatively, the mounting bracket 98 may take the form of a generally U-shaped "universal" mounting bracket as described above, which is pivotally mounted to a mounting boss fixed to the rear surface of each backrest support member 24, wherein the boss includes an integral saddle that extends through an opening in the backrest panel 16, and rests on the surface of an associated support member where it is secured in fixed position by blind rivets, generally illustrated in FIGS. 15-18. In such an alternate design, the saddle projects rearwardly from the backrest support member 24 and the U-shaped mounting bracket is pivotally mounted on a inwardly facing surface of the saddle by an associated pivot fastener which passes through an opening in the throat of the bracket to support the bracket to pivot about an inwardly extending axis relative to the saddle that carries it. Outwardly extending ears on the mounting bracket include apertures for receiving a pivot pin for securing a terminal upper end of an associated one of the connectors 44 that comprise the rear X-frame connector assembly 38.

In an alternate embodiment of the chair 10 as illustrated in FIGS. 11-14, the lower terminal ends of the rear X-frame connectors 44 are attached to the linkages 60 arranged to pivot relative to the rear leg members 22 when the back support 40 is reclined or when the chair 10 is set-up or collapsed. More particularly, the rear X-frame connectors 44 are attached to the linkages 60 via the generally U-shaped "universal" mounting brackets 54 pivotally mounted on the inner side of each linkage 60 by an associated pivot fastener that passes through an opening in the throat of the bracket 54 to support it for pivoting relative to the linkage 60. Outwardly extending ears on the mounting bracket 54 have apertures for receiving a pivot pin for securing a terminal lower end of an associated one of the rear X-frame connectors 44.

In another alternate embodiment as illustrated in FIGS. 15-18, the lower terminal ends of the rear X-frame connectors 44 are attached to sliding sleeves or collars 74 that are constructed and arranged to slide axially along the rear leg members 22 at opposite sides of the chair frame 12, thereby providing third means for adjusting the positions of the rear X-frame connectors relative to the rear leg members 22. As previously noted, the rear leg members 22 may be formed with circular or non-circular cross-section, for example, elliptical or oval cross-section. The sleeves 74 are adapted to slidably travel on the leg members 22, and thus preferably have interior slide bores that complement the cross-sectional configuration of the leg members on which they are mounted. The generally U-shaped "universal" mounting brackets 54 are pivotally mounted to the sleeves 74 by an associated pivot fastener that passes through an opening in the throat of the bracket 54 to support it for pivoting relative to the sleeve 74 on which it is mounted. Outwardly extending ears on the mounting bracket 54 have apertures for receiving a pivot pin for securing a terminal lower end of an associated one of the rear X-frame connectors 44.

In accordance with the present invention, the back support 40 is intended to be reclinable. It should be apparent that the weight of a person seated in the chair 10 and resting against the backrest panel 16 will tend to cause the chair back to hinge in a rearward direction about its horizontal pivotal support axis if rearwardly directed force is acting upon the back support 40. The force exerted on the chair frame 12 will also be translated into downwardly directed forces applied to the rear mounting brackets 54 and 98 with resulting torque applied to the rear leg members 22 by the forces outwardly acting on the brackets 54 and 98. Various means can be used to prevent such collapsing, buckling, or bowing actions. For example, such actions can be prevented by using a rear X-lock assembly 102, which generally comprises a lock bar 104 extending between upper ends of the rear X-frame connector assembly 38, as described in more detail below. Alternatively, a combination of the rear X-lock assembly 102 and non-circular legs interacting with complementary shaped sliding sleeves or collars 74 may restrict buckling of the frame 12. In other embodiments, circular legs with correspondingly shaped sliding sleeves 74 can be used, with an X-lock assembly 102 provided to compensate for the user's weight and prevent inward buckling. Still alternately, the X-lock assembly 102 need not be used, but where buckling is accommodated for with the structure of guide rail assemblies 46 or the pivoting linkages 60 on the rear leg members 22 that permit the rear X-frame connectors 44 to maintain adequate structural integrity to support a seated person. Still alternately, other shapes for the frame members can be used, including circular tubing with a guide rail mounted thereon and a complementary shaped slide collar comprising a circular opening with a key-way to accommodate the guide rail and prevent twisting of the slide collar.

As noted, the afore-described back support collapse problem can also be overcome by the provision of a collapsible X-lock assembly 102 that is pivotally connected at its opposite ends to the rear X-frame connector assembly 38. The collapsible lock bar 104 is comprised of two distinct lock bar sections 104*a* and 104*b*. Each section 104*a* and 104*b* extends inwardly from an associated rear X-frame connector 44 and toward the other bar section. One of the bar sections can further extend outward past its associated X-frame connector to form a handle extension for facilitating locking and unlocking of the lock assembly 102. The inner ends of the two bar sections 104*a* and 104*b* are pivotally connected to each other in spaced apart relation and arranged for click or snap engagement to releaseably retain the sections 104*a* and 104*b* in a locked position wherein the lock bar 104 is substantially straight and extends between the rear X-frame connectors 44.

One or both connectors 44 which provide pivotal connection between the outer ends of the lock bar sections 104*a* and 104*b* may also be designed to permit click or snap engagement with the lock bar 104 to assure that the X-lock assembly 102 maintains the two X-frame connectors 44 in pivoted spaced-apart relation when the chair 10 is in its set-up condition. Light pressure on the handle extension, if provided, or, alternatively, light pressure applied to the central connection point of the lock bar sections 104*a* and 104*b* is sufficient to collapse the lock bar 104 so that it may be folded to a fully collapsed position wherein the two sections 104*a* and 104*b* of the lock bar 104 are disposed in generally side-by-side relation when the chair frame 12 is moved to its collapsed position as shown in FIGS. 9-10. Thus, the X-lock assembly 102 provides an effective means for stabilizing the back support 40 and preventing the back support members 24 on a chair 10 with a reclinable back from moving toward each other when a reclining user is seated in the chair 10.

The X-lock assembly 102 can be positioned at different heights relative to the back support 40 or the rear legs 22, depending on the maximum weight the chair 10 is expected to handle. For example, the embodiment of the X-lock assembly 102 illustrated in FIGS. 3-6 is mounted on the lower portions of the rear frame connectors 44 beneath the centrally located pivot point of the rear connector assembly 38. FIG. 7 illustrates this version of the X-lock assembly 102 in a disengaged condition. In an alternate embodiment of the X-lock assembly 102 illustrated in FIGS. 15-16, the lock bar 104 is mounted as the upper portions of the rear frame connectors 44 above the centrally located pivot point of the rear connector assembly 38.

The X-frame connector assemblies 36 and 38 need not be in the form of an X. Alternate designs providing substantial support include vertical parallel support braces, H-shaped assemblies, and variations of X- and H-shaped assemblies.

When the chair 10 is not in use, it may be prepared for storage or transportation by folding it into its collapsed condition. The chair 10 can be folded from the set-up condition to the completely collapsed condition with a single folding action—preferably by grabbing a portion of the chair frame 12 on each side of the seat panel 14 (e.g., grabbing the armrests 28) and pressing inward and lifting upwards at the same time. The frame members of the chair 10 will collectively pivot, slide, fold and/or telescope to move the various frame members towards a vertical center axis to collapse the frame in multiple directions, including left-to-right and front-to-back. Prior to collapsing the frame 12, the X-lock assembly 102, if used, must be disengaged. The end result will be a compact bundle wherein the various axially elongated structural members will be disposed in relatively closely spaced apart side-by-side relation to each other and have a common general direction of axial extent, as shown in FIGS. 9-10. It will be noted that the X-lock assembly 102 connected to the rear X-frame connectors 44 is disposed in a collapsed condition when the chair 10 is collapsed, and the seat panel 14 and the backrest panel 16 have a flaccid condition and form part of the collapsed bundle.

As discussed herein, the structure of the chair 10 in accordance with the present invention provides a simple approach for folding the chair 10 to a collapsed condition where the chair 10 can be folded from a conventional set-up condition, as shown in FIG. 1, to a completely collapsed and bundled condition, as shown in FIGS. 9-10, with a single folding action. That is, where the user of the chair 10 desires to fold the chair 10 into a compact, bundled condition for easy transportation and/or storage, the user can simply press inwardly on the chair frame 12, for example, on the armrests 28 of the chair 10. This inwardly directed force causes the frame members and frame connectors to move substantially in unison and in multiple directions relative to each other while undergoing multiple changes of angular position relative to each other. For example, the inwardly directed folding force causes the frame side assemblies 18L and 18R to move toward each other. As a lateral pressure is exerted on the chair frame 12, the X-frame connector assemblies 36 and 38 elongate, with each connector 44 or 80 of the respective X-frame moving relative to the other toward parallel relationship. With the elongation of the front X-frame connectors 80 about a central pivot point, the front leg members 20 are caused to telescope—i.e., the movement of the connectors 80 influences the telescoping lower front leg section 20*b* within the upper front leg section 20*a* to telescope outwardly—to thereby effectively lengthen the front leg members 20 of each frame side assembly 18L and 18R.

The lengthening of the front leg members 20 causes the front and rear leg members 20 and 22 to pivot and move toward each other and toward a parallel relationship. Since the extra support member 96 is fixed to the front foot 30 on the frame side assemblies 18L and 18R, telescoping movement of the front foot 30, along with the lower front leg section 20*b* to which it is secured, exerts a downward directing force on the support member 96. The support member 96, however, is fixed at its other end to the seat support portion 26 of the rear leg member 22. Thus, the downwardly directed force exerted on the support member 96 causes it to pull the front leg member 20 and the rear leg member 22 towards each other—i.e., in a front-back folding manner. The movement of the support member 26 thereby influences movement of the rear leg member 22 about the pivot therebetween and into a folded condition. The overlying result of this linkage design is that the front and rear leg members 20 and 22 move and are folded together as the frame side assemblies 18R and 18L move laterally together, ending in a completely bundled chair assembly, as shown in FIGS. 9-10. As so collapsed, the frame members and frame connectors end up with generally common directions of extent. As shown, for example, the frame members and frame connectors all lie in generally parallel condition.

Another available embodiment of a chair design in accordance with the present invention can utilize a support member connected between the front leg member 20 and the seat frame portion 26 of the rear leg member 22. In such an embodiment, the front leg 20 is angularly disposed in an open, set-up condition between the front foot 30 and the back of the seating area. The support member is pivotally mounted between the forward end of the seat frame member 26 and to the lower end of the front leg member 20 and is generally vertically disposed when the chair is in an open, set-up condition. More particularly, the support member may be pivotally mounted to a collar or sleeve slidingly mounted on the front leg member 20. As the chair is folded to its completely collapsed condition, the sleeve slides up the front leg member 20 as the support member pivots, so that the chair frame 12 can be collapsed tightly. In such a design, the front leg member 20 need not telescope during folding of the chair. Instead, the movement of the sleeve allows the frame members to collapse to a bundled condition without the lengths of any of the frame members inhibiting the collapsing action.

When the chair 10 is in its set-up condition, the flexible seat panel 14 and backrest panel 16 will be held tautly on the frame. However, when the chair 10 is folded to its collapsed condition, the seat panel 14 and backrest panel 16 will be in a flaccid condition and form a part of the bundle.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A unifoldable reclining chair comprising:

an articulated frame defining a back support and a seat support, wherein said frame has a set-up condition and a collapsed condition, and wherein in said set-up condition, the back support is adapted to be angularly adjusted between at least two reclined positions relative to the seat support;

a flexible seat panel mounted on the seat support of the frame, said flexible seat panel defining a generally taut chair seat when same frame is in its set-up condition; and a flexible backrest panel mounted on the back support of the frame, said flexible backrest panel defining a generally taut chair backrest when said frame is in its set-up condition;

wherein said frame comprises a pair of side frame assemblies of opposite hand disposed in generally parallelly extending and transversely spaced apart opposing relation to each other in the set-up condition of said chair, each said side frame assembly having a plurality of generally axially elongated frame members being interconnected for pivotal movement relative to one another about generally transversely extending pivot axes, said frame members including:

a front leg member;

a rear leg member;

a seat support member defining a respective side of the seat support;

a back support member defining a respective side of the back support; and an armrest;

wherein said frame further comprises generally transversely extending front and rear connector assemblies extending between and pivotally connected to said side frame assemblies for transversely moving said side frame assemblies towards and away from each other during collapsing or set-up of the chair frame;

wherein each lower end of the rear connector assembly is movably attached to a respective one of the rear leg members of the frame for movement between first and second positions spaced apart along the respective rear leg member, said positions corresponding to respective first and second reclined positions of the back support relative to the seat support;

wherein said chair in its collapsed condition forms a bundle with all of the frame members and the front and rear connector assemblies gathered together from the set-up condition and having generally common directions of extent; and wherein said chair is folded from its set-up condition to its collapsed condition with a single folding action.

2. The unifoldable reclining chair according to claim 1, wherein the front and rear connector assemblies each comprises a pair of axially elongated frame connectors generally centrally joined each to the other for limited pivotal movement about a pivot axis between a generally X-shaped condition associated with the set-up condition of the chair and a generally parallel condition associated with the collapsed condition of the chair.

3. The unifoldable reclining chair according to claim 2, wherein an upper terminal end of each rear frame connector is pivotally attached to a respective back support member of the chair frame, and a lower terminal end of each rear frame connector is pivotally attached to a respective rear leg member of the chair frame.

4. The unifoldable reclining chair according to claim 3, wherein the lower terminal end of each rear frame connector is slidably and pivotally attached to a respective rear leg member by a guide rail assembly including a guide rail having a longitudinal slot disposed therein, and a slide disposed within the slot for movement along the length of the guide rail, wherein the lower terminal end of the rear frame connector is pivotally attached to the slide.

5. The unifoldable reclining chair according to claim 3, wherein the lower terminal end of each rear frame connector is pivotally attached to a respective rear leg member by a pivotal linkage connected between the lower terminal end of the rear frame connector and the respective rear leg member.

6. The unifoldable reclining chair according to claim 3, wherein the lower terminal end of each rear frame connector is slidably attached to a respective rear leg member by a sleeve mounted on the rear leg member for movement therealong, wherein the lower terminal end of the rear frame connector is pivotally attached to the sleeve.

7. The unifoldable reclining chair according to claim 1, wherein a lower terminal end of the rear connector assembly is movable to a plurality of intermediate positions between the first and second positions, whereby each intermediate position is associated with a reclined position of the back support relative to the seat support.

8. The unifoldable reclining chair according to claim 1, wherein the rear leg member and the seat support member are integrally formed to define a single generally axially elongated member, whereby the rear leg portion and the seat support portion of said integral member are connected by an intermediate bend.

9. A unifoldable reclining chair comprising:

an articulated foldable frame;

a flexible seat material mounted on said frame;

a flexible back material mounted on said frame;

said frame being adapted to rest on a generally horizontally oriented supporting surface in a set-up condition with said flexible seat material defining a generally taut chair seat support and said flexible back material defining a generally taut chair back support for collectively accommodating an upright seated or reclined chair occupant;

said frame having a pair of side frame assemblies of opposite hand disposed in generally parallelly extending and transversely spaced apart opposing relation to each other in said set-up condition, each of said side frame assemblies having a plurality of generally axially elongated side frame members, said side frame members of each of said assemblies being disposed within generally parallelly extending vertical planes and connected each to another for pivotal movement relative to each other about generally transversely extending pivot axes, said side frame members including front and rear leg members with respective front and rear feet; and said frame further having a plurality of connecting assemblies each including generally axially elongated connecting members, said connecting assemblies extending between and movably attached at each end thereof by pivotal connections to said side assemblies and supporting said side assemblies for transverse movement toward each other and away from each other and to said transversally spaced apart condition, each of said connecting assemblies having a lower end thereof that is movably attached to a respective rear leg member for motion therealong between a reclined position and an upright position; and enabling means for requiring both said side members and said connecting members to move substantially in unison and in multiple directions relative to each other, and to undergo multiple changes of angular position relative to each other, in response to a single frame collapsing force applied to a plurality of said frame members to cause said chair frame to move directly from said set-up condition to said collapsed condition in response to a single collapsing action, and for permitting the chair back support of said chair frame to be moved between seated and reclined positions at all times that said chair is in said set-up condition;

said chair in said collapsed condition forming a bundle with all of said side members and all of said connecting members having generally common directions of extent with said front and rear leg members substantially parallel each other and all of said front and rear feet closely spaced, and with said seat material and said back material forming part of said bundle and having a flaccid condition.

10. The unifoldable reclining chair as set forth in claim 9, wherein each rear leg has a guide rail assembly mounted thereon, said guide rail assembly comprises a guide rail defining a longitudinal slot and a slide disposed within the slot for movement in one and an opposite direction along the length of the guide rail, wherein a lower terminal end of one of said connecting members is pivotally connected to the slide for movement therewith.

11. The unifoldable reclining chair as set forth in claim 9, wherein each of said connecting members has a slide member pivotally connected to a lower terminal end thereof and is slidably supported on a respective rear leg for movement in one and an opposite direction therealong.

12. The unifoldable reclining chair as set forth in claim 9, wherein said frame includes a link comprising said enabling means and has connecting points at its opposite ends and one of said connecting points is pivotally connected to an associated one of said connecting members and the other of said connecting points is pivotally connected to an associated one of said side frame members.

13. The unifoldable reclining chair as set forth in claim 12, wherein each of said side frame assemblies has a back support member pivotally connected to a respective rear leg for movement between upright seating and reclined seating positions and said enabling means further comprises means for preventing said back support member from bowing inward and in a direction of an opposite side of said chair in response to the weight of said occupant of said chair.

14. The unifoldable reclining chair according to claim 2, further comprising a locking mechanism connected between the frame connectors of the rear connector assembly for releasably retaining the side frame assemblies in said transversally spaced apart condition when locked and thereby preventing said chair from being moved to its collapsed condition, wherein said locking mechanism, when unlocked, permits collapsing of the chair.

15. The unifoldable reclining chair according to claim 14, wherein said locking mechanism comprises a lock bar having a plurality of pivotally connected parts and an operating handle.

16. The unifoldable reclining chair according to claim 9, further comprising a locking mechanism connected between the connecting members of one of the connecting assemblies for releasably retaining the side frame assemblies in said transversally spaced apart condition when locked and thereby preventing said chair from being moved to its collapsed condition, wherein said locking mechanism, when unlocked, permits collapsing of the chair.

17. A unifoldable reclining chair comprising:

an articulated frame defining a back support and a seat support, wherein said frame has a set-up condition and a collapsed condition, and wherein in said set-up condition, the back support is adapted to be angularly adjusted between at least two reclined positions relative to the seat support;

a flexible seat panel mounted on the seat support of the frame, said flexible seat panel defining a generally taut chair seat when same frame is in its set-up condition; and a flexible backrest panel mounted on the back support of the frame, said flexible backrest panel defining a generally taut chair backrest when said frame is in its set-up condition;

wherein said frame comprises a pair of side frame assemblies of opposite hand disposed in generally parallelly extending and transversely spaced apart opposing relation to each other in the set-up condition of said chair, each said side frame assembly having a plurality of generally axially elongated frame members being interconnected for pivotal movement relative to one another about generally transversely extending pivot axes, said frame members including:

a front leg member ending at a front foot;

a rear leg member ending at a rear foot;

a seat support member defining a respective side of the seat support;

a back support member defining a respective side of the back support; and an armrest;

wherein said frame further comprises generally transversely extending front and rear connector assemblies extending between and pivotally connected to said side frame assemblies for transversely moving said side frame assemblies towards and away from each other during collapsing or set-up of the chair frame;

wherein each lower terminal end of the rear connector assembly is movably attached to a respective one of the rear leg members of the frame for movement between first and second positions spaced apart along the respective member, said positions corresponding to respective first and second reclined positions of the back support relative to the seat support;

wherein said chair in its collapsed condition forms a bundle with all of the frame members and the front and rear connector assemblies gathered together from the set-up condition with front leg members, rear leg members, and back support members substantially parallel and with all of its front feet and rear feet closely spaced; and wherein said chair is folded from its set-up condition to its collapsed condition with a single folding action.

18. The unifoldable reclining chair according to claim 17, wherein the lower ends of the rear connector assembly are movably attached to the rear leg members for sliding movement.

19. The unifoldable reclining chair according to claim 17, wherein the lower ends of the rear connector assembly are movably attached to the rear leg members for swinging movement.

* * * * *